US008417129B2

(12) United States Patent
Sugiura

(10) Patent No.: US 8,417,129 B2
(45) Date of Patent: Apr. 9, 2013

(54) METHOD OF READING INDIVIDUAL INFORMATION OF A DETACHABLE UNIT, INDIVIDUAL INFORMATION READING DEVICE, APPARATUS HAVING THE INDIVIDUAL INFORMATION READING DEVICE, AND A DETACHABLE UNIT

(75) Inventor: Takashi Sugiura, Kashiwa (JP)

(73) Assignee: Canon Kabushiki Kaisha (JP)

( * ) Notice: Subject to any disclaimer, the term of this patent is extended or adjusted under 35 U.S.C. 154(b) by 1090 days.

(21) Appl. No.: 12/123,941

(22) Filed: May 20, 2008

(65) Prior Publication Data

US 2008/0298820 A1 Dec. 4, 2008

(30) Foreign Application Priority Data

May 22, 2007 (JP) ..... 2007-135950

(51) Int. Cl.
*G03G 15/00* (2006.01)
*G03G 15/08* (2006.01)

(52) U.S. Cl.
USPC ..... 399/12; 399/262

(58) Field of Classification Search ..... 399/12, 399/13, 262; 235/462.01, 462.12
See application file for complete search history.

(56) References Cited

U.S. PATENT DOCUMENTS 5,164,574 A 11/1992 Ujiie et al.
5,229,585 A 7/1993 Lemberger et al.
5,317,139 A 5/1994 Evans et al.
5,983,059 A * 11/1999 Oka et al. ..... 399/262
5,999,759 A * 12/1999 Palumbo et al. ..... 399/262 X
6,164,540 A * 12/2000 Bridgelall et al. ..... 235/462.01
6,240,262 B1 5/2001 Taniyama et al.
6,301,449 B1 * 10/2001 Miura ..... 399/12
6,895,191 B2 * 5/2005 Rommelmann et al. ..... 399/12
7,044,463 B2 * 5/2006 Brotherston et al. 235/462.01 X
2003/0116617 A1 6/2003 Perkins et al.
2008/0025735 A1 1/2008 Odani

FOREIGN PATENT DOCUMENTS

EP 0500277 A2 8/1992
GB 1329337 A 9/1973
JP 4-1682 A 1/1992
JP 5054152 A 3/1993
JP 5-224479 A 9/1993
JP 7-36348 A 2/1995

(Continued)

OTHER PUBLICATIONS

Search report, dated Sep. 4, 2008,issued in corresponding EP Application No. 08156748.9-1240.

(Continued)

*Primary Examiner* — Sandra Brase
(74) *Attorney, Agent, or Firm* — Rossi, Kimms & McDowell LLP

(57) ABSTRACT

In an apparatus including the detachable unit, when reading individual information of the detachable unit, a first label for generating a reference signal for reading individual information and a second label representing the individual information are arranged on a surface of the detachable unit, with a first label reading unit, the reference signal is generated while reading the first label in a predetermined direction, and with a second label reading unit, the individual information of the detachable unit contained in the second label is read in synchronous with the generated reference signal. Read individual information is stored, and whether a mounted detachable unit is new or used is recognized based on a comparison of individual information read from the detachable unit with stored individual information.

11 Claims, 20 Drawing Sheets

FOREIGN PATENT DOCUMENTS

| | | | |
|---|---|---|---|
| JP | 8-39824 | A | 2/1996 |
| JP | 11153929 | A | 6/1999 |
| JP | 2000-3116 | A | 1/2000 |
| JP | 2000-66554 | A | 3/2000 |
| JP | 2004-309945 | A | 11/2004 |
| JP | 2005345773 | A | 12/2005 |

OTHER PUBLICATIONS

Search report, dated Dec. 4, 2008 issued in corresponding EP Application No. 08156748.9-1240/1995644.

Japanese Office Action for corresponding JP 2007-135950, mail date Apr. 16, 2012.

* cited by examiner

METHOD OF READING INDIVIDUAL INFORMATION OF A DETACHABLE UNIT, INDIVIDUAL INFORMATION READING DEVICE, APPARATUS HAVING THE INDIVIDUAL INFORMATION READING DEVICE, AND A DETACHABLE UNIT

BACKGROUND OF THE INVENTION

1. Field of the Invention

The present invention relates to a method of reading individual information of a detachable unit, an individual information reading device, an apparatus having the individual information reading device, and a detachable unit, and more particularly to reading individual information of a detachable unit in an image forming apparatus such as a printer, copier or facsimile having a developer for developing a latent image on a latent image carrier and a toner storage for supplying internally stored toner to the developer.

2. Description of the Related Art

The technical field covered by the present invention is not limited to an image forming apparatus such as a printer, copier or facsimile. However, the related art will now be described using the example of an image forming apparatus such as a printer, copier or facsimile provided with a developer for developing a latent image on a latent image carrier and a toner storage for supplying internally stored toner to the developer.

With the above conventional image forming apparatus, a one-component developing method and a two-component developing method are known as methods of developing a latent image carried on a latent image carrier such as a photosensitive member. The one-component developing method involves developing the latent image using a one-component developing material consisting primarily of toner. In contrast, the two-component developing method involves developing the latent image using a two-component developing material containing toner and a magnetic carrier.

Since the stocked amount of toner is limited in both methods, new toner needs to be set in the image forming apparatus as necessary. As for the method of setting new toner, a method is known in which a toner contained type developer filled with toner is replaced at the point at which the toner runs out. A method is also known in which new toner is supplemented directly to the image forming apparatus or together with a toner storage unit. The latter method is advantageous in terms of running costs.

An image forming apparatus in which new toner is set therein using the latter method is disclosed in Japanese Patent Laid-Open No. 2000-3116. The image forming apparatus comprises a toner storage (hopper) that stores toner for supplying to the developer, remaining toner remaining amount calculation means that calculates the amount of toner remaining in the toner storage, and display means that displays the calculated amount of remaining toner. The remaining toner remaining amount calculation means calculates the amount of remaining toner in the toner storage based on the accumulated number of rotations of a motor constituting a driving source of a movable member disposed in the toner storage, and displays the calculated amount of remaining toner on the display means. The user is able to judge whether toner setting is required in relation to the image forming apparatus based on this display, and set new toner in the toner storage as necessary. However, a large toner storage capable of stocking a large amount of toner is required in order to avoid a situation where the user is forced to perform toner setting frequently.

In order to control the change in state resulting from toner setting, information required in image forming or information indicating new or used may be provided on a detachable unit such as a toner bottle or a toner cartridge. Methods using thermosensible paper typified by Japanese Patent Laid-Open No. 07-036348 and memory methods typified by Japanese Patent Laid-Open No. 2004-309945 are exemplary means of realizing the above. Methods using simple barcodes typified by Japanese Patent Laid-Open No. 08-039824 have has also be proposed.

However, a method that uses thermosensible paper such as Japanese Patent Laid-Open No. 07-036348 unavoidably requires electrical contacts. The presence of these electrical contacts, which are a contributing factor in contact failure and the like, decreases the reliability of the apparatus.

While a contactless memory method such as Japanese Patent Laid-Open No. 2004-309945 is superior in terms of reliability, the configuration is complex and costly, and the placement of conductors such as metal is restricted given the use of radio waves.

Consequently, a method such as Japanese Patent Laid-Open No. 08-039824 that involves appended a barcode to a detachable unit is used in order to realize a simple configuration cost effectively. However, when a simple barcode method is used with a detachable unit as in Japanese Patent Laid-Open No. 08-039824, the barcode data cannot be stably detected.

For example, the following problem occurs when reading a barcode from a rotating toner bottle. That is, a brush motor is generally used to rotate the toner storage unit. Since the torque required for rotation varies depending on the amount of remaining toner in the toner storage unit, a brush motor is employed as a motor tolerant of such variation. While this brush motor has a large torque and is effective against load fluctuation, it is difficult to maintain a prescribed rotation speed. Hence, the difficulty in reading the barcode at a constant speed makes it high likely that reading errors will occur.

On the other hand, the following problem occurs when reading a barcode from a toner cartridge during insertion. That is, the barcode data cannot be stably detected since the speed at which the detachable unit is inserted varies from person to person.

A specific example of these problems will be described in accordance with FIG. 21. FIG. 21 shows the possibility of instability or reading errors occurring when reading individual information from a single label. FIG. 21 illustrates two diagrams, top and bottom.

The top diagram shows data being read correctly. Reference numeral 2105*x* denotes a data label, and 2300*x* shows the timing at which data is sampled. When there is only one label, the data sampling 2300*x* needs to be performed at regular time intervals. A binary signal can be read when sampling data, depending on whether the label is black or white. With the top diagram, the data can be correctly read as "11010010111001101" as in 2301*x*.

On the other hand, the bottom diagram shows what happens when the rotation or insertion speed is doubled. In this case, even though the data label 2105*y* is the same as the data label 2105*x*, data can only be sampled as shown in 2300*y*, resulting in imported data of "110011011" as shown in 2301*y*. Thus, the read data is obviously incorrect.

SUMMARY OF THE INVENTION

It is desirable to solve one or more of the above problems. It is also desirable to provide a method of reading individual information and an individual information reading device that enable individual information of a detachable unit to be stably read with a simple configuration.

The present invention also provides an image forming apparatus having the individual information reading device and a detachable unit.

The present invention in its first aspect can provide a method of reading individual information of a detachable unit that is adapted to be mounted in an apparatus and that has, on a surface thereof, a first label for generating a reference signal for reading individual information, and a second label representing the individual information, the method comprising: reading, with a first label reading unit, the first label in a predetermined direction while generating the reference signal; and reading, with a second label reading unit, the individual information of the detachable unit contained in the second label, in synchronism with the generated reference signal.

The present invention in its second aspect can provide an individual information reading device for reading individual information of a detachable unit that is mountable in or on an apparatus and that has on a surface thereof a first label for generating a reference signal for reading individual information and a second label representing the individual information, the individual information reading device comprising: a first label reading unit operable to read, the first label in a predetermined direction while generating the reference signal; and a second label reading unit operable to read the individual information of the detachable unit contained in the second label in synchronism with the generated reference signal.

The present invention in its third aspect can provide an apparatus adapted to have a detachable unit mounted in or on it and comprising the above mentioned individual information reading device.

The present invention in its forth aspect can provide a detachable unit adapted to be mounted in or on an apparatus that reads individual information of the detachable unit when the detachable unit is mounted in or on the apparatus, the detachable unit having, on a surface thereof, a first label, readable by the apparatus to generate a reference signal, and a second label, representing the individual information of the detachable unit and readable by the apparatus using the reference signal.

An embodiment of the present invention can enable individual information of a detachable unit to be stably read with a simple configuration. For example, an embodiment of the present invention can enable individual information of a toner bottle or a toner cartridge to be stably read with a simple configuration in an image forming apparatus. Further, an embodiment of the present invention can also enable the new or used state of the toner bottle or toner cartridge to be detected based on the read individual information.

Further features of the present invention will become apparent from the following description of exemplary embodiments (with reference to the attached drawings).

DESCRIPTION OF THE EMBODIMENTS

Embodiments of the present invention will now be described in detail with reference to the accompanying drawings. Note that the present embodiment will be described using the reading of individual information from a toner bottle or a toner cartridge constituting a detachable unit in an electrophotographic printer as an example. However, the technique of the present invention is not limited to this configuration, and may be applied to the reading of individual information from a detachable unit in a generic apparatus, with such configurations also being covered by the invention.

Embodiment 1

Embodiment 1 in which the present invention is applied to an electrophotographic printer (hereinafter, "printer") constituting an image forming apparatus will now be described.

Exemplary Configuration of Image Forming Apparatus of Embodiment 1

Figure 1:
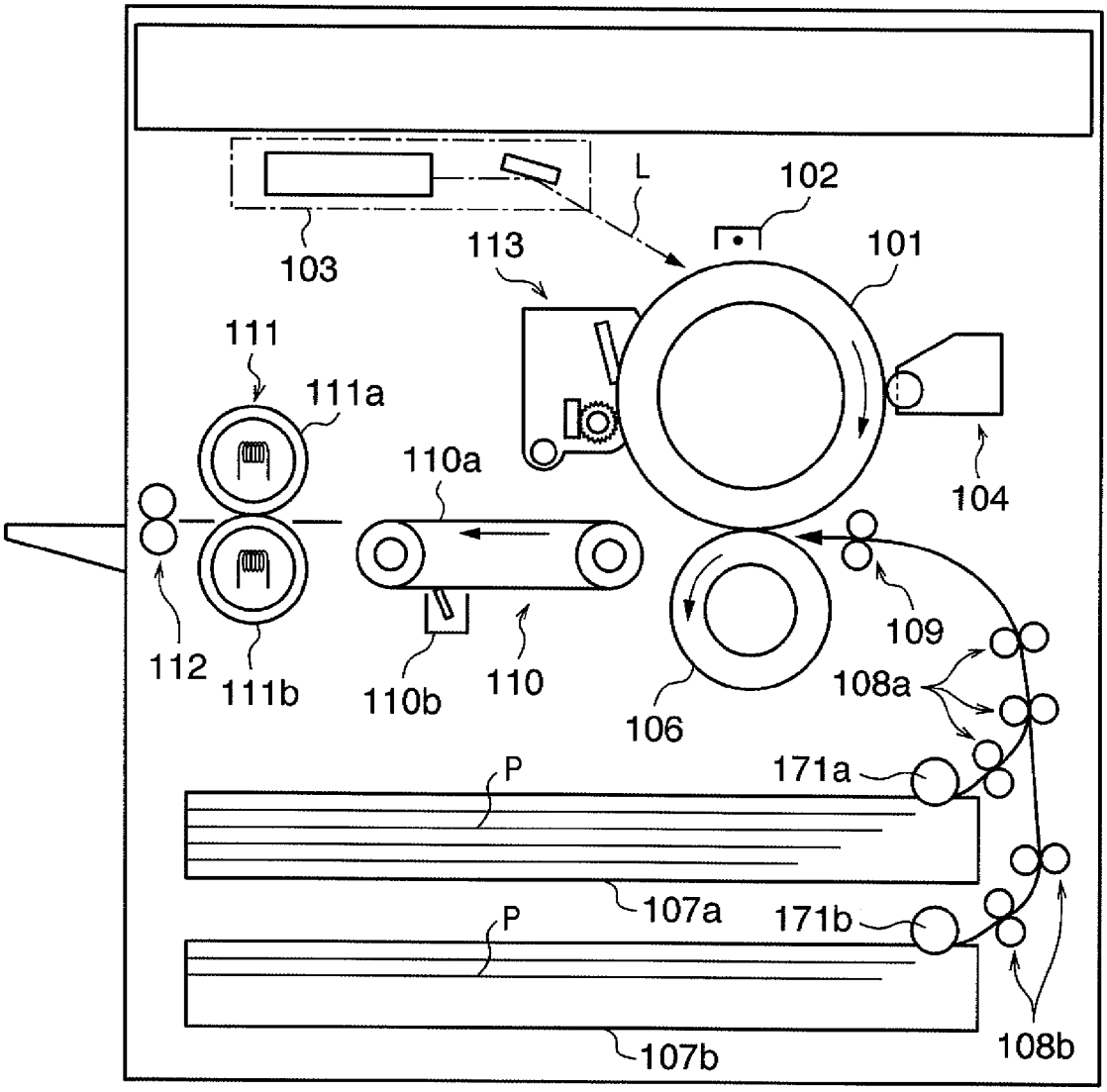
FIG. 1 shows an exemplary schematic configuration of a printer according to Embodiment 1.

Firstly, the basic configuration of the printer will be described. FIG. 1 is a schematic configuration diagram showing the printer according to Embodiment 1.

In FIG. 1, a drum-like photosensitive member 101 serving as a latent image carrier for carrying a latent image is rotationally driven clockwise in FIG. 1 at a prescribed linear velocity by a drive portion (not shown). After the surface of the photosensitive member 101 has been uniformly charged by a charger 102, an electrostatic latent image is carried on the surface thereof as a result of an optical scan based on image information being performed by an optical scanning unit 103. This image information is sent from a personal computer or the like (not shown).

The electrostatic latent image formed on the photosensitive member 101 is developed into a toner image by a developer 104 that uses a two-component developing material containing toner and a magnetic carrier, and the toner image is then electrostatically transferred at a transfer nip portion (described below) to transfer paper serving as a transfer member.

A transfer portion having a transfer roller 106 is disposed below the photosensitive member 101. Apart from the transfer roller 106 shown in FIG. 1, this transfer portion has a drive portion that rotationally drives the transfer roller 106, and a power supply (not shown) that applies a transfer bias to the transfer roller 106. The transfer roller 106 contacts the photosensitive member 101 at a prescribed pressure to form the transfer nip portion, while being rotationally driven counterclockwise in FIG. 1, so that the surface thereof moves in the same direction as the surface of the photosensitive member 101 at the contact portion. A transfer electric field is formed at the transfer nip portion by the effect of the transfer bias.

Two paper feed cassettes 107*a* and 107*b* that hold transfer paper P serving as a transfer member in plural sheet stacks are disposed below the transfer portion in FIG. 1, so as to overlap vertically. These paper feed cassettes 107*a* and 107*b* deliver the transfer paper P to a paper conveying path as a result of paper feed rollers 171*a* and 171*b* that press against the uppermost sheet of transfer paper P being by rotationally driven at a prescribed timing. The delivered transfer paper P passes through plural pairs of conveying rollers 108*a* and 108*b*, and comes to a rest nipped between the pair of registration rollers 109.

The pair of registration rollers 109 deliver the nipped transfer paper P to the transfer nip portion at a timing that enables the transfer paper P to be superposed on the toner image formed on the photosensitive member 101. The toner image on the photosensitive member 101 and the transfer paper P fed out by the pair of registration rollers 109 thus contact in synchronous each other at the transfer nip portion, and the toner image is electrostatically transferred to the transfer paper P by the effect of the transfer electric field and nip pressure (transfer pressure).

A paper conveying unit 110 that endlessly moves an endless paper conveying belt 110*a* looped around two rollers in the counterclockwise direction in FIG. 1 is disposed to the left of the transfer roller 106 in FIG. 1. A fixing device 111 and a pair of discharge rollers 112 are disposed in order further to the left of this paper conveying unit 110 in FIG. 1.

The transfer paper P on which the toner image has been electrostatically transferred at the transfer nip portion is passed to the fixing device 111 after been delivered on the paper conveying belt 110*a* of the paper conveying unit 110 with the rotation of the photosensitive member 101 and the transfer roller 106.

The fixing device 111 forms a fixing nip portion using a pair of fixing rollers 111*a* and 111*b* that each have an internal heat source such as a halogen lamp and rotate in contact with one another at a uniform speed. These fixing rollers 111*a* and 111*b* are maintained at a prescribed surface temperature (e.g., 165-185° C.) as a result of the power supply to the heat sources being on/off controlled based on the detection results of respective surface temperature sensors (not shown). The toner image is fixed on the surface of the transfer paper P passed to the fixing device 111 as a result of the transfer paper P being subjected to heat and pressure treatment while nipped in the fixing nip portion. The transfer paper P is then ejected from the fixing device 111 to the outside of the printer via the pair of discharge rollers 112.

Any toner remaining on the surface of the photosensitive member 101 without being electrostatically transferred to the transfer paper P at the transfer nip portion is removed from the photosensitive member 101 by a photosensitive member cleaner 113. The surface of the photosensitive member 101 thus cleaned is then uniformly charged by the charger 102 after firstly being neutralized by a neutralizing portion (not shown). Any toner displaced from the photosensitive member 101 to the paper conveying belt 110*a* at the transfer nip portion is removed from the paper conveying belt 110*a* by a belt cleaning device 10*b* of the paper conveying unit 110. Note that the photosensitive member cleaner 113 has a zinc stearate coating portion for coating the surface of the photosensitive member 101 with a zinc stearate powder obtained by scratching with a zinc stearate rod. Coating the surface of the cleaned photosensitive member 101 with zinc stearate powder lowers the surface friction coefficient of the photosensitive member 101, enabling transferability to be improved. Note that remaining toner removed from the photosensitive member 101 by the photosensitive member cleaner 113 and toner removed from the paper conveying belt 110*a* by the belt cleaning device 10*b* is returned to the developer 104 or a hopper portion 105 (not shown in FIG. 1) and recycled.

Exemplary Configuration of Developer and Hopper Portion

Figure 2:
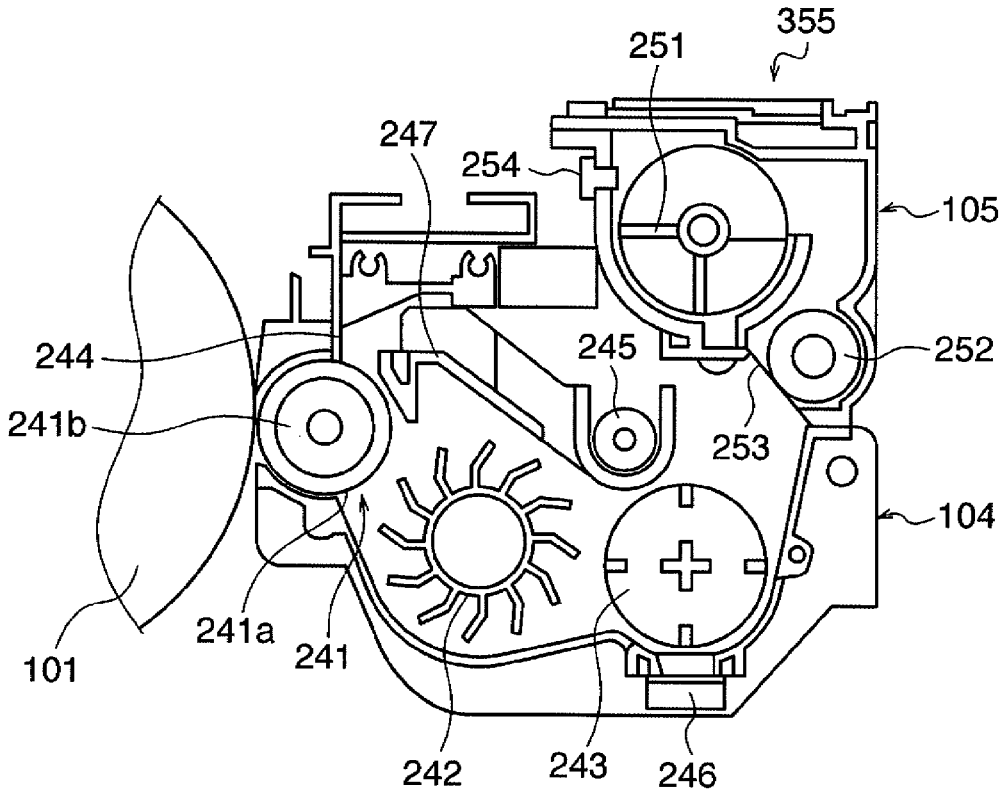
FIG. 2 is an enlarged view of a photosensitive member and a developer of the printer in FIG. 1 as seen from the same direction as FIG. 1.

FIG. 2 is an enlarged configuration diagram showing the photosensitive member 101 and the developer 104.

In FIG. 2, a hopper portion 105 serving as a toner storage is connected to the developer 104 which is disposed to the side of the photosensitive member 101. This hopper portion 105 has a toner conveying screw 251, a gear-like toner supply roller 252 serving as a movable member, a toner supply-amount regulating plate 253, and a toner detection sensor 254. The toner (not shown) in the hopper portion 105 is gradually flows down onto the toner supply roller 252 which is disposed to the lower right of the toner conveying screw 251 in FIG. 2, while being conveyed in the screw axial direction (depth direction in FIG. 2) by the toner conveying screw 251 which is disposed parallel to the photosensitive member 101. The toner that flows down is supplied to the developer 104 after the thickness thereof on the toner supply roller 252 has been regulated by the toner supply-amount regulating plate 253 while being carried around on the surface of the toner supply roller 252.

The developer 104 has a developing roll 241, a mixing paddle 242, a mixing roller 243, a regulating blade 244, a conveying screw 245, a toner density sensor (hereinafter, "toner sensor") 246, and a separator 247 disposed to the right of the developing roll 241 in FIG. 2. A two-component developing material containing toner and a magnetic carrier (not shown) is stored in the developer 104.

Toner supplied to the developer 104 from the hopper portion 105 flows down onto the mixing roller 243 which is rotationally driven by a drive portion (not shown). The mixing roller 243 delivers this toner toward the mixing paddle 242 to the left in FIG. 2, while mixing and agitating the toner with the two-component developing material (hereinafter, simply "developing material"). At this time, freshly supplied toner is frictionally charged as a result of rubbing against the magnetic carrier, the mixing roller 243 and the like.

The mixing paddle 242 conveys the developing material delivered from the mixing roller 243 toward the developing roll 241 as a result of being rotationally driven clockwise in FIG. 2 by a drive portion (not shown). The developing material thus conveyed is drawn up on the surface of a rotating developing sleeve 241*a* of the developing roll 241.

The developing roll 241 has the developing sleeve 241*a* which is composed of a nonmagnetic pipe rotationally driven by a drive portion (not shown), and a magnet roll 241*b* on the inside of the developing sleeve 241*a* that is fixed to the developer 104 so as to not rotate together with the developing sleeve 241*a*. The developing material delivered from the mixing paddle 242 is drawn up and carried on the surface of the developing sleeve 241*a* by the magnetic force of the magnet roll 241*b*. The thickness of the layer of developing material is regulated by the regulating blade 244 which is disposed so as to maintain a prescribed gap with the developing roll 241, while the developing material is being carried around on the developing sleeve 241*a*. The developing material is then conveyed with the rotation of the developing sleeve 241*a* to a developing portion at which the developing roll 241 opposes the photosensitive member 101.

A developing bias is applied to the developing sleeve 241*a* by a power source (not shown). As a result of this application, a developing potential that causes toner to be electrostatically transferred from the developing sleeve 241*a* to the photosensitive member 101 acts between the developing sleeve 241*a* and the electrostatic latent image on the photosensitive member 101 at a developing portion. Also, a non-developing potential that causes toner to be electrostatically transferred from the photosensitive member 101 to the developing sleeve 241*a* acts between the developing sleeve 241*a* and non-image areas (non-latent image areas) of the photosensitive member 101. Therefore, toner in the developing material conveyed to the developing portion only adheres to the electrostatic latent image on the photosensitive member 101, developing the electrostatic latent image into a toner image. Developing material that passes through the developing portion with the rotation of the developing sleeve 241*a* is collected in the developer 104.

As aforementioned, the thickness of the layer of developing material on the developing sleeve 241*a* of the developing roll 241 is regulated by the regulating blade 244. Developing material that is prevented from being carried around on the developing sleeve 241*a* as a result of this regulation is retained upstream of the regulating blade 244 in the rotation direction of the developing sleeve 241*a*. The retained developing material then overflows onto the separator 247 which is disposed to the right of the developing roll 241 in FIG. 2, as a result of being pushed by developing material subsequently carried around on the developing sleeve 241*a*. Overflowing developing material moves under gravity along the sloped upper face of the separator 247 and is guided toward the conveying screw 245.

The conveying screw 245 agitates and conveys the developing material guided thereto by the separator 247 in the axial direction (depth direction in FIG. 2) thereof. So-called horizontal mixing is thus performed on the developing material in the developer 104. In contrast to this horizontal mixing, the mixing roller 243 and the mixing paddle 242 perform so-called vertical mixing for mixing developing material conveyed in the rotational direction thereof. Developing material conveyed by the conveying screw 245 is flows down onto the mixing roller 243 while being horizontally mixed, and then passes along a vertical mixing path formed by the mixing roller 243 and the mixing paddle 242. Some of that developing material again overflows from the developing sleeve 241*a* onto the separator 247 and is guided toward to the conveying screw 245. A vertical circulation path of developing material is thus formed in the developer 104.

The toner sensor 246 is fixed to the base of the casing below the mixing roller 243, and outputs a signal that depends on the magnetic permeability of the developing material agitated and conveyed by the mixing roller 243 to a control portion (not shown). Toner density of the developing material is detected as a result of the toner sensor 246 detecting the magnetic permeability of the developing material, given that toner density shows a favorable correlation with magnetic permeability. Toner density is effectively detected as a result of the toner sensor 246 detecting magnetic permeability, given that the toner density of the developing material shows a good correlation with the magnetic permeability of the developing material.

The control portion is configured so as to perform the following toner density control. That is, this control involves rotationally driving the toner supply roller 252 in the hopper portion 105 as necessary to supply toner from the hopper portion 105 to the developer 104, so that the output signal from the toner sensor 246 approximates a prescribed target value. The toner density of the developing material in the developer 104 is thus maintained within a prescribed range. Since the magnetic permeability of the developing material fluctuates, however, due to changes in toner density and environmental changes such as humidity, the control portion appropriately revises this target value. Specifically, a reference toner image is formed on the photosensitive member 101 at a prescribed timing, and the target value is revised based on the toner adherence amount per unit area relative to this reference toner image. Note that the toner adherence amount per unit area relative to the reference toner image is ascertained, for example, using the output voltage value of a reflective photosensor that detects the light reflectance of the reference toner image.

Figure 3:
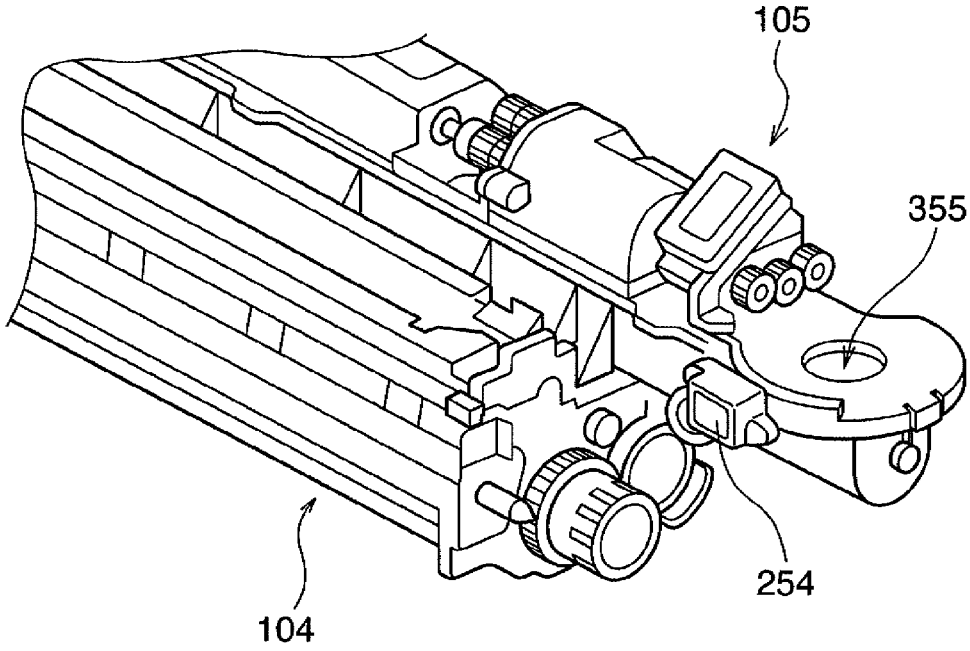
FIG. 3 is a perspective view of an exemplary configuration of an end portion of both the developer and a hopper portion of the printer in FIG. 1 as seen from the upper left of FIG. 2.

FIG. 3 is a perspective view of an end portion of the developer 104 and the hopper portion 105 as seen from the upper left of FIG. 2.

An inlet 355 for receiving toner supplied from a toner bottle (not shown) is provided on an upper wall of the hopper portion 105, which is disposed above the developer 104, in proximity to the end portion thereof (in FIG. 2, the position of the inlet 355 is marked by an arrow). Toner supplied from the inlet 355 to the hopper portion 105 is detected by the toner detection sensor 254 serving as a toner detection unit fixed to a side face of the hopper portion 105. As for the toner detection sensor 254, a sensor that detects the presence of toner by utilizing the fact that the adhesion of toner interferes with the vibration of a detection face vibrated by a piezoelectric vibrator can be used, for example. A reflective photosensor or the like may also be used.

Exemplary Configuration of Toner Supply Device

Figure 4:
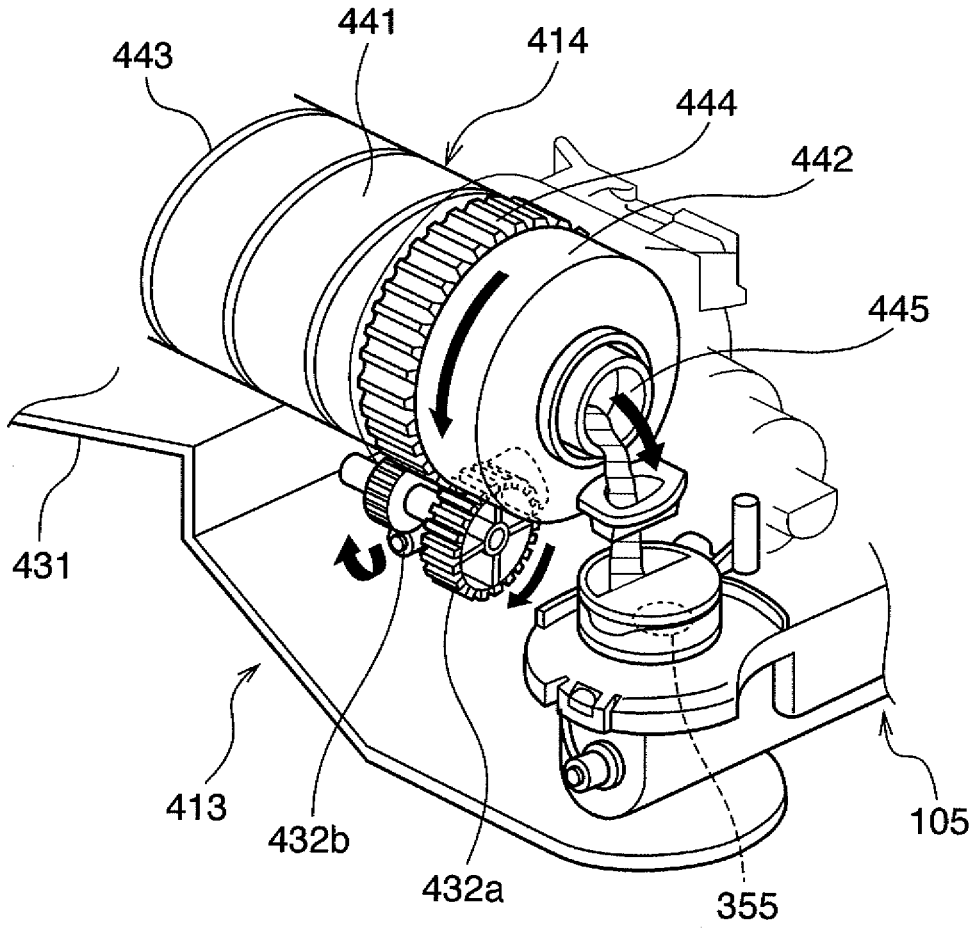
FIG. 4 is a perspective view of an exemplary configuration of an end portion of a toner supply device in addition to an end portion of the hopper portion of the printer in FIG. 1 as seen from the upper right of FIG. 2.

FIG. 4 is a perspective view of an end portion of a toner supply device 413 that supplements the toner of the printer in addition to an end portion of the hopper portion 105 as seen from the upper right of FIG. 2.

In FIG. 4, the toner supply device 413 has a support member 431 that supports a toner bottle 414 (detachable unit), a drive gear 432*a* for rotating the toner bottle 414, and a supply motor 432*b* that transmits rotational driving force to the drive gear 432*a*. The toner bottle 414 is supported above the hopper portion 105 in an elongated position lying on its side and orthogonal to the longitudinal direction of the hopper portion 105, so that the end of the toner bottle 414 is positioned directly above the inlet 355 of the hopper portion 105.

The toner bottle 414 serving as a toner storage unit that stores toner internally has a bottle-like bottle body 441 and a cap portion 442 fixed to a top portion of the bottle body 441. A spiral projection 443 that protrudes toward the bottle axis is provided on an internal face of the bottle body 441. A gear 444 is provided on an external face of the cap portion 442. The support member 431 of the toner supply device 413 supports the toner bottle 414 so that the drive gear 432*a* engages this gear 444. When the supply motor 432*b* is driven by the control portion (not shown), the rotational driving force thereof is transmitted to the gear 444 of the cap portion 442 via the drive gear 432*a*. The toner bottle 414 is thus rotated counterclockwise in FIG. 4, and toner in the bottle moves toward the cap portion 442 with the spiral movement of the spiral projection 443. Some of the toner is then discharged from a discharge outlet 445 constituting a storage unit opening provided in an end face of the cap portion 442, and supplied to the hopper portion 105 via the inlet 355 in the hopper portion 105.

Figure 5:
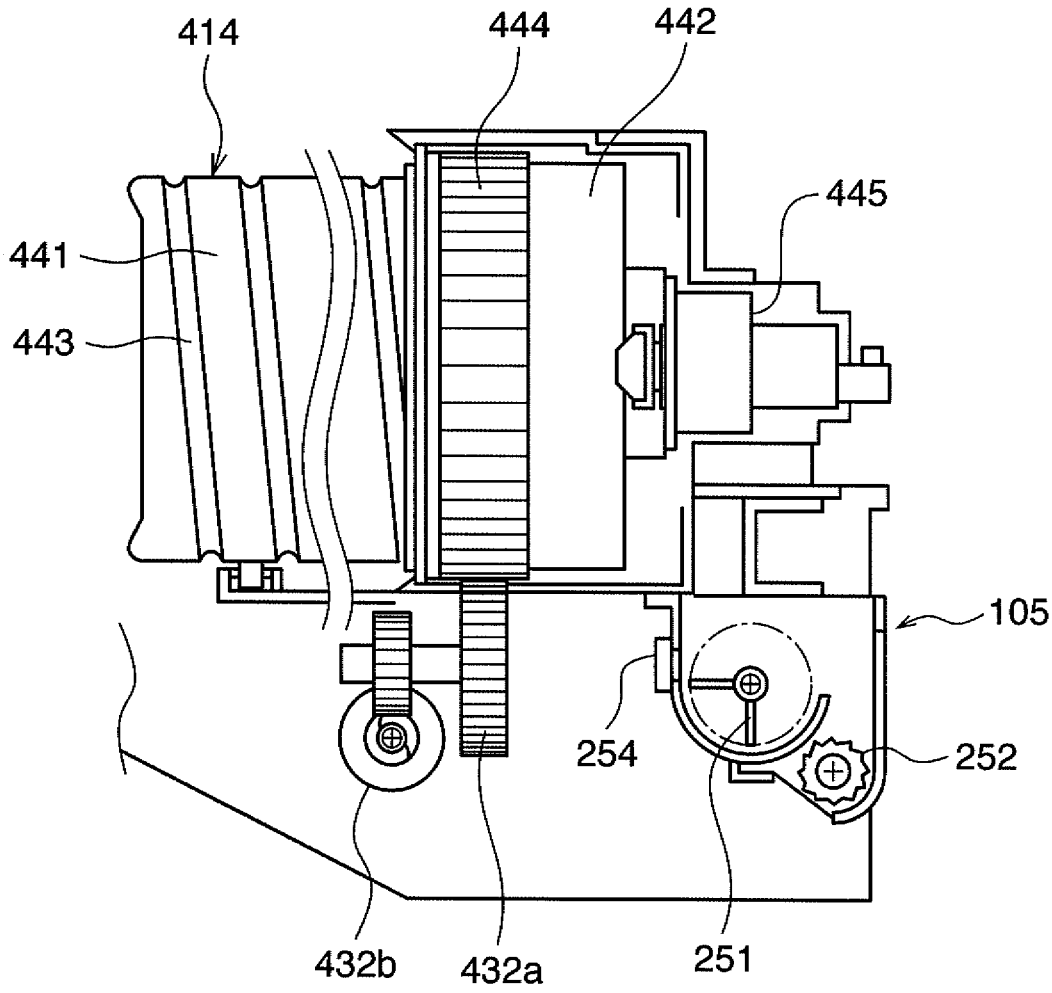
FIG. 5 is an enlarged view of an exemplary configuration of an end portion of a toner bottle in addition to the hopper portion of the printer in FIG. 1 as seen from the same direction as FIG. 2.

FIG. 5 is an enlarged configuration diagram of an end portion of the toner bottle 414 in addition to the hopper portion 105 as seen from the same direction as FIG. 2. Note that reference numerals that are the same as FIGS. 2 to 4 indicate the same constituent elements.

In FIG. 5, toner (not shown) supplied from the toner bottle 414 to the hopper portion 105 flows down onto the toner conveying screw 251 which is provided directly beside the toner detection sensor 254. The toner then gradually flows down toward the toner supply roller 252 while being conveyed in the depth direction of the screw axis.

The control portion is configured so as to implement a toner supply control that involves driving the supply motor 432*b* based on the detection result of the toner detection sensor 254 to supply toner from the toner bottle 414 to the hopper portion 105. Specifically, toner is supplied from the hopper portion 105 to the developer 104 (see FIG. 2) as a result of the toner density control, and when the toner in the hopper portion 105 starts to run out, the toner detection sensor 254 no longer detects toner. When toner is no longer detected by the toner detection sensor 254, the control portion rotationally drives the supply motor 432*b* until toner is detected.

The amount of toner discharged from the toner bottle 414 per rotation of the bottle varies greatly depending on the amount of remaining toner in the toner bottle 414. This variation is caused by the surface level of toner in the toner bottle 414 varying according to the amount of remaining toner. Specifically, the toner bottle 414 is mounted to the toner supply device so as to lie on its side, as aforementioned. When the toner bottle 414 lying on its side is substantially full of toner, the surface level of toner in the toner bottle 414 will be vertically higher than the discharge outlet (445 in FIG. 4), and the discharge outlet will be completely covered with toner. Toner will be discharged from the entire area of the discharge outlet 445 with the rotation of the toner bottle 414, resulting in a large amount of toner being discharged per rotation. In contrast, when there is a small amount of toner remaining in the toner bottle 414, the surface level of the toner in the toner bottle 414 will be vertically lower the discharge outlet 445, and the discharge outlet will no longer be covered with toner. When this happens, toner will only be discharged from a lower portion of the discharge outlet 445 with the rotation of the toner bottle 414, resulting in an extremely small amount of toner being discharged per rotation. To obtain a toner discharge amount equivalent to when the toner bottle 414 is full, the toner bottle 414 must be rotated anywhere from a few times to a few dozen times.

Since the toner discharge amount is thus unstable, the toner bottle 414 is ill-suited as a toner supply unit for supplying toner to the developer 104 in order to restore the toner density of the developing material. In view of this, the printer is configured so that toner discharged from the toner bottle 414 is received by and temporarily stored in the hopper portion 105, and then supplied to the developer 104 from there. As aforementioned, toner supply to the hopper portion 105 is commenced when toner is no longer detected around the toner conveying screw 251 by the toner detection sensor 254. The toner supply roller 252 supplying toner from the hopper portion 105 to the developer 104 is disposed vertically lower than this toner conveying screw 251. As a result, the toner supply roller 252 is constantly immersed in toner provided there is no sudden malfunction, and the amount of toner supplied per rotation is extremely stable. Precise toner density control is performed as a result of supplying toner gradually to the developer 104 by driving the toner supply roller 252 which thus has an extremely stable toner supply.

Replacing a toner bottle 414 that still has toner inside with a new toner bottle 414 is uneconomical because the toner in the bottle ends up being needlessly discarded. Also, if notification that toner in the toner bottle 414 has run out is performed without advance notice, it is impossible to provide the user with sufficient time to prepare a new toner bottle 414. Therefore, it is desirable to quantitatively detect the amount of remaining toner in the toner bottle 414 using some sort of method, and notify the user of the detected amount.

As for the method of detecting the amount of remaining toner, a method that involves computing the accumulated amount of toner supplied from the hopper portion 105 to the developer 104 based on the drive period of the toner supply roller 252, and deriving the amount of remaining toner based on the computation result is conceivable. However, the toner supply roller 252 fixed inside the hopper portion 105 is not designed to be periodically replaced. Thus, the amount of toner supplied per revolution changes over time as the toner supply roller 252 gets toner solidified and wears with long-term use. The accuracy with which the amount of remaining toner is detected thus deteriorates over time when the amount of remaining toner is detected based on the drive period of the toner supply roller 252.

Exemplary Configuration of Individual Information Reading Device of Embodiment 1

Figure 6:
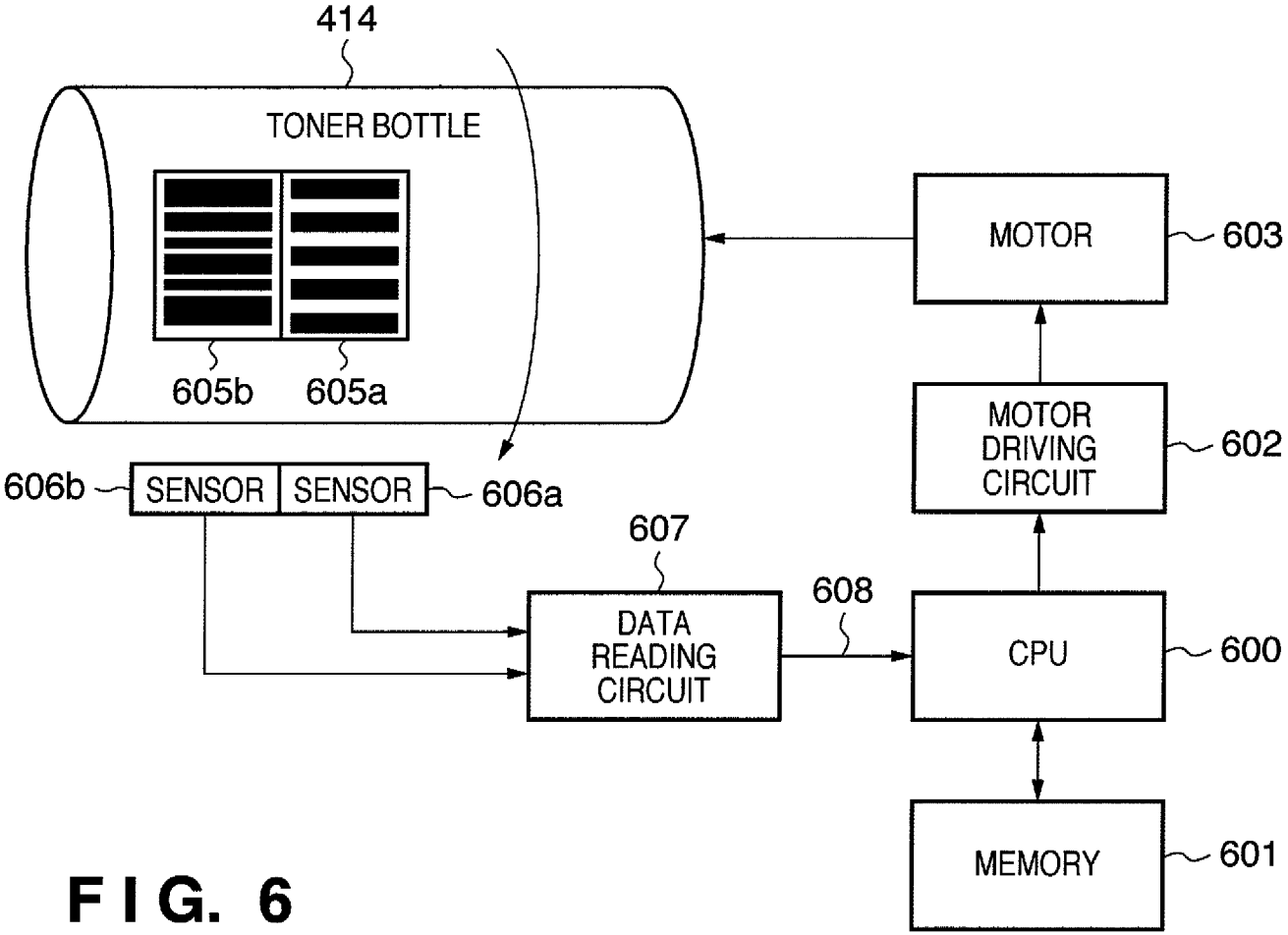
FIG. 6 is a block diagram showing an exemplary configuration of an individual information reading device in Embodiment 1.

FIG. 6 is a block diagram showing an exemplary configuration of the individual information reading device in Embodiment 1.

In FIG. 6, reference numeral 600 denotes a CPU that controls the individual information reading device. Reference numeral 601 denotes a memory that stores data (described below). Reference numeral 602 denotes a motor driving circuit that performs driving in accordance with a drive signal received from the CPU 600. Reference numeral 603 denotes a motor for rotating the toner bottle 414. The motor 603 is driven by the motor driving circuit 602.

Reference numerals 605*a* and 605*b* denote labels stuck to the toner bottle 414 that contain individual information unique to the toner bottle. The labels 605*a* and 605*b* stuck to the toner bottle 414 are read by sensors 606*a* and 606*b*. Data is read from these sensors 606*a* and 606*b* by a data reading circuit 607. An output 608 of the data reading circuit 607 is input to the CPU 600.

Next, the operations of the individual information reading device in the present embodiment will be described.

Various situations are conceivable in which label reading could be performed, such as when powering on the device or when replacement of the toner bottle 414 (representing the detachable unit of the present invention) is detected, although the present invention is not particularly limited in this respect. To rotate the toner bottle 414, a signal is sent to the motor driving circuit 602, which then rotates the motor 603. The sensors 606*a* and 606*b* start reading the labels 605*a* and 605*b*, after a prescribed period has elapsed and a prescribed speed (not a fixed speed, since it is set depending on the remaining toner amount, etc.) has been reached, and after it has been confirmed that the toner bottle 414 is rotating. Signals obtained from the sensors 606*a* and 606*b* are input to the data reading circuit 607. Data processed by this data reading circuit 607 is input to the CPU 600. The processed data is also stored in the memory 601 at this time. Also, it is permissible to utilize history data stored in memory, in order to recognize whether the same bottle is still being used.

Figure 7:
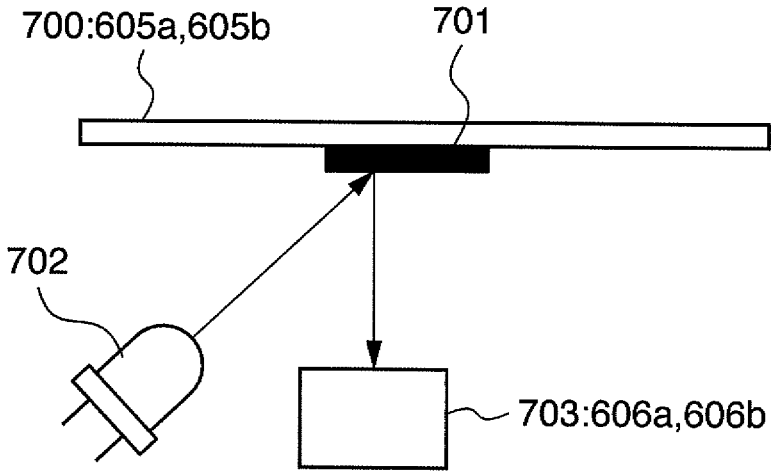
FIG. 7 illustrates of a schematic of a label and a sensor in Embodiment 1.

FIG. 7 shows the relation between a sensor and a label.

Reference numeral 700 denotes a label (equivalent to 605*a*, 605*b* in FIG. 6), and 701 denotes ink on the label. Reference numeral 702 denotes a light emitting portion, with a generic light source such as an LED being used. Reference numeral 703 (equivalent to 606*a*, 606*b* in FIG. 6) denotes a sensor for receiving light diffusely reflected from the label after being irradiated from the light emitting portion 702. While not shown in FIG. 7, the fact that a difference occurs in the amount of light received by the sensor 703 depending on the presence of the ink 701 on the label 700 may be utilized to recognize the presence of ink bars on the label 700 using a threshold in the sensor 703. Alternatively, this may be realized with comparators and the reference voltage of an external circuit (see FIG. 10).

Exemplary Configuration of Control Portion in Individual Information Reading device of Embodiment 1

Figure 8:
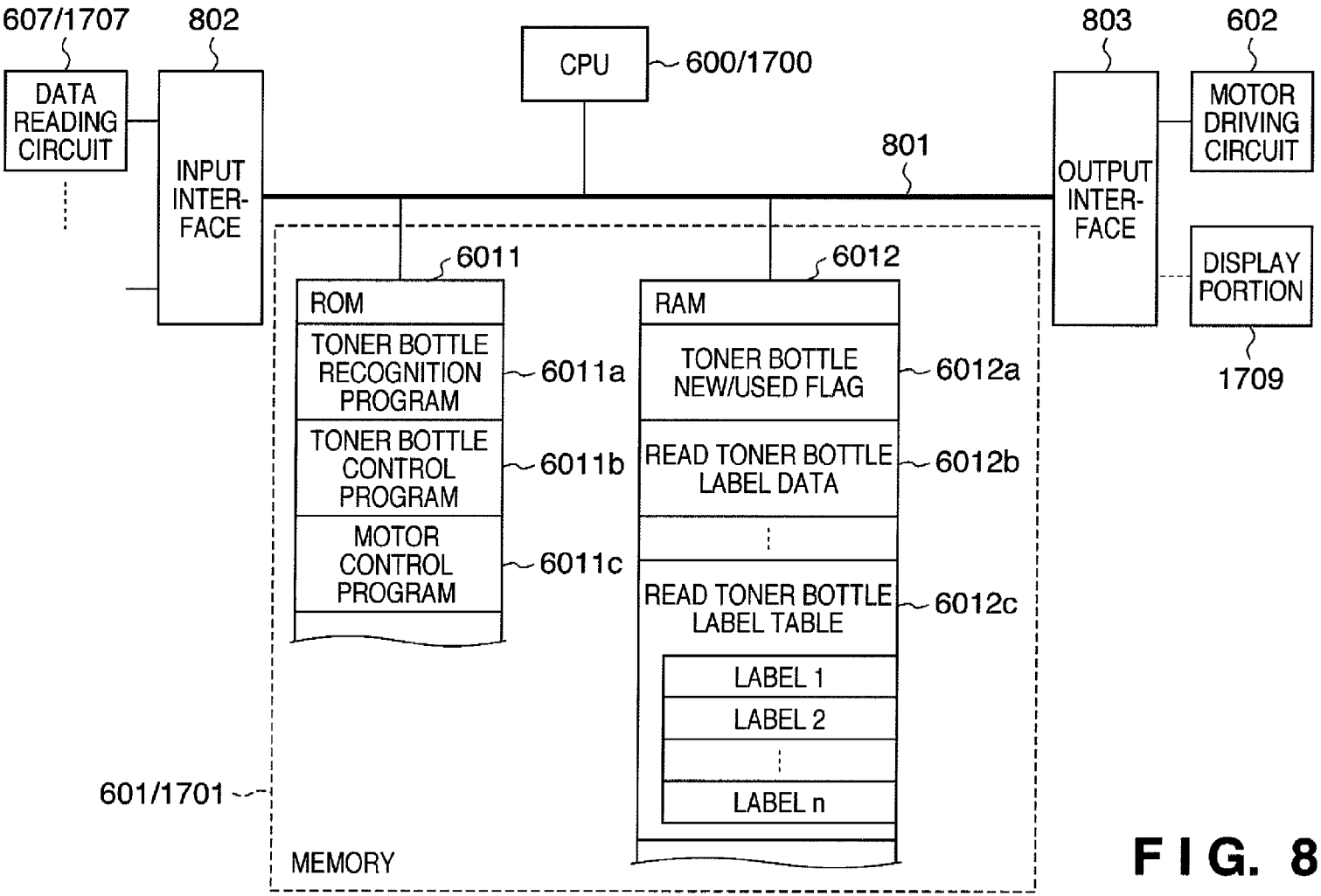
FIG. 8 is a block diagram showing an exemplary configuration of a control portion in the individual information reading device of Embodiment 1.
Figure 17:
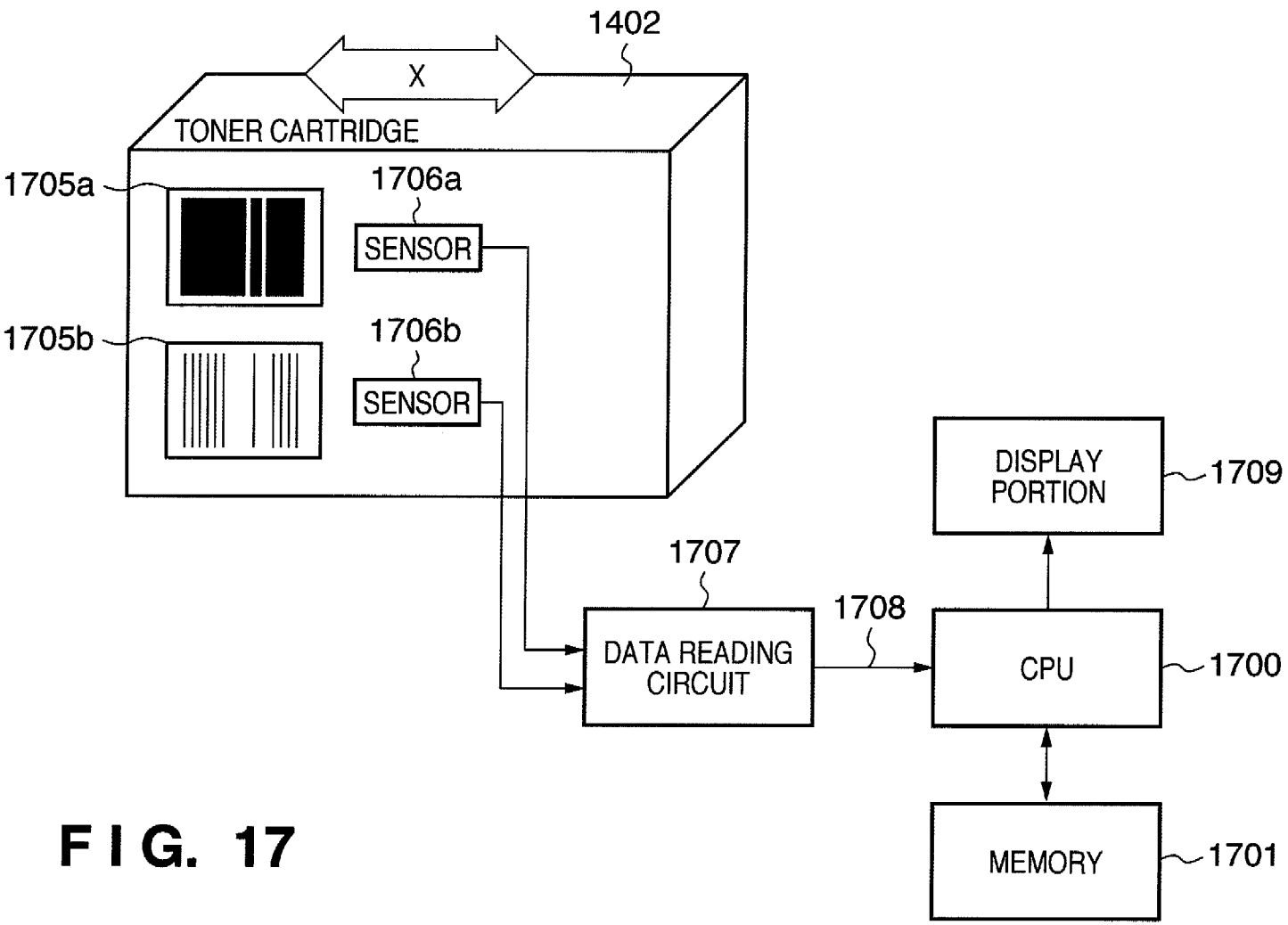
FIG. 17 is a block diagram showing an exemplary schematic configuration of the individual information reading device in Embodiment 2.

FIG. 8 is a block diagram showing an exemplary configuration of the control portion in the individual information reading device that includes the CPU 600 (1700) and the memory 601 (1701) in FIG. 6 (FIG. 17). Note that only computer programs and data associated with the present embodiment are shown in FIG. 8.

In FIG. 8, the CPU 600 (1700) executes the processing of the present embodiment in accordance with computer programs stored in a ROM 6011 of the memory 601 (1701), while using an area secured in a RAM 6012.

A toner bottle recognition program 6011*a* for reading individual information from the labels on the toner bottle and recognizing whether a toner bottle currently mounted is new or used from the read individual information is stored in the ROM 6011. A toner bottle control program 6011*b* for controlling the toner bottle based on the read and recognized individual information is also stored in the ROM 6011. In the case of Embodiment 1, a motor control program 6011*c* for controlling the motor 603 via the motor driving circuit 602 is also stored in the ROM 6011. Note that in the case of Embodiment 2, the initial term "toner bottle" of the programs is changed to "toner cartridge".

An area storing a flag 6012*a* for indicating the new or used state of a toner bottle based on a judgment result as to whether the currently mounted toner bottle is new or used is secured in the RAM 6012. An area for storing individual information (read toner bottle label data) 6012*b* read from the label of a toner bottle is also secured in the RAM 6012. An area for storing a read toner bottle label table 6012*c* that accumulates the individual information of toner bottles read up until this point is also secured in the RAM 6012. Read labels 1 to n are accumulated in the read toner bottle label table 6012*c*. Here, information on each read label including the rotation control parameters, status, history and the like of the toner bottle is stored in correspondence with identification information of the toner bottle, as the individual information of the toner bottle, and used by the toner bottle control program 6011*b* and the motor control program 6011*c*. Note that in the case of Embodiment 2, the initial term "toner bottle" of the data is changed to "toner cartridge".

In FIG. 8, reference numeral 802 denotes an input interface to which data from the data reading circuit 607 (1707) is input in the present example. Reference numeral 803 denotes an output interface from which data is output to the motor driving circuit 602 in Embodiment 1 and to a display portion 1709 in Embodiment 2. Reference numeral 801 denotes a bus connecting the constituent elements in FIG. 8.

Figure 9:
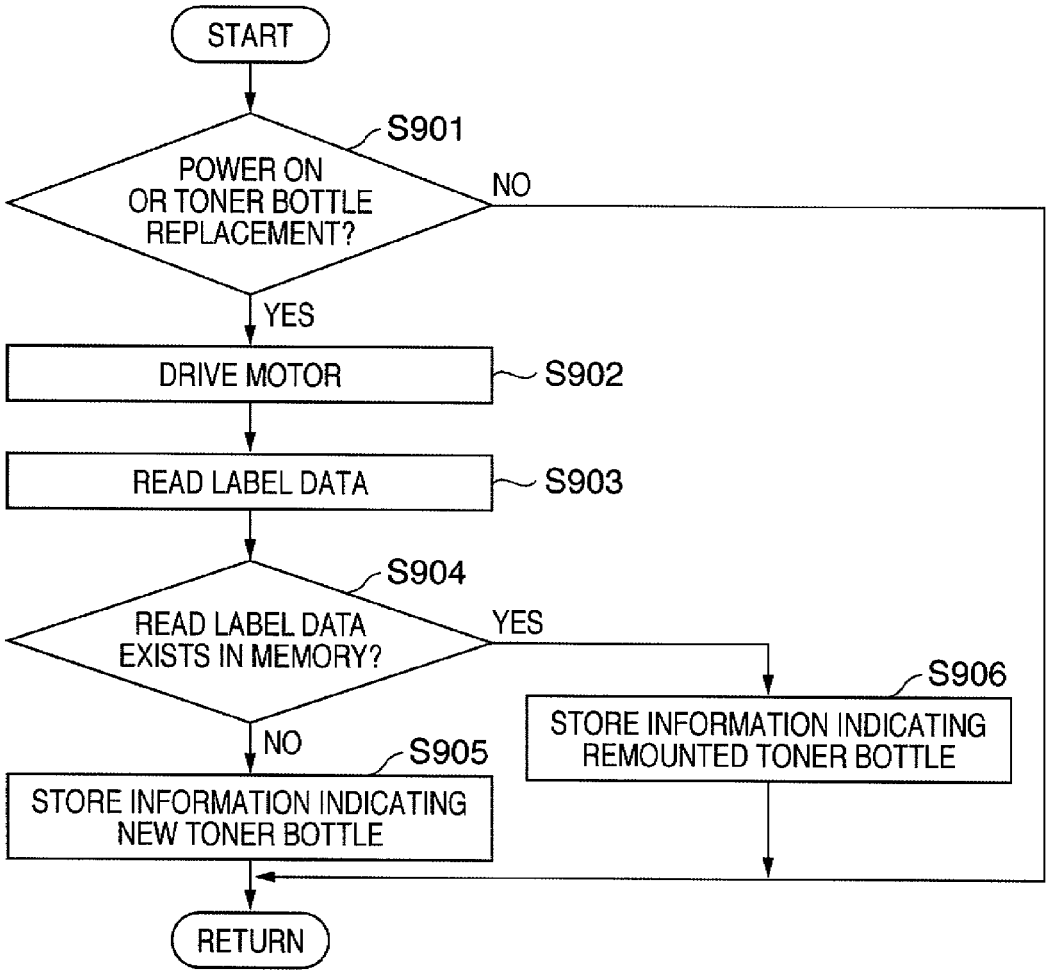
FIG. 9 is a flowchart showing an exemplary operation procedure of the individual information reading device in Embodiment 1.

FIG. 9 is a flowchart showing an exemplary processing procedure included in the toner bottle recognition program 6011*a* of the present embodiment.

Firstly, at step S901, it is determined whether device power on or toner bottle replacement is being performed. This determination is realized by a sensor, a switch or the like (not shown). If device power on or toner bottle replacement is not being performed, the processing is ended and returns to the main apparatus control routine. If device power on or toner bottle replacement is being performed, the processing proceeds to step S902 and the motor is driven. When the motor reaches a prescribed speed, reading of label data according to the present embodiment is performed at step S903, and the read individual information is stored in the RAM 6012.

At step S904, identification information included in the read individual information is compared with identification information included in the individual information stored in the read toner bottle label table 6012*c*. If there is no individual information with matching identification information in the read toner bottle label table 6012*c*, the processing proceeds to step S905. In step S905, it is recognized that the mounted toner bottle is new and information indication new toner bottle is stored in RAM 6012. On the other hand, if there is individual information with matching identification information in the read toner bottle label table 6012*c*, the processing proceeds to step S906. In step S906, the mounted toner bottle is recognized as having been remounted for reuse and information indicating remount toner bottle is stored in RAM 6012.

Note that the processing procedures of the toner bottle control program 6011*b* and the motor control program 6011*c* will not be explicated here, since they do not form the subject matter of the present invention.

Specific Example 1 of Individual Information Reading Device of Embodiment 1

Figure 10:
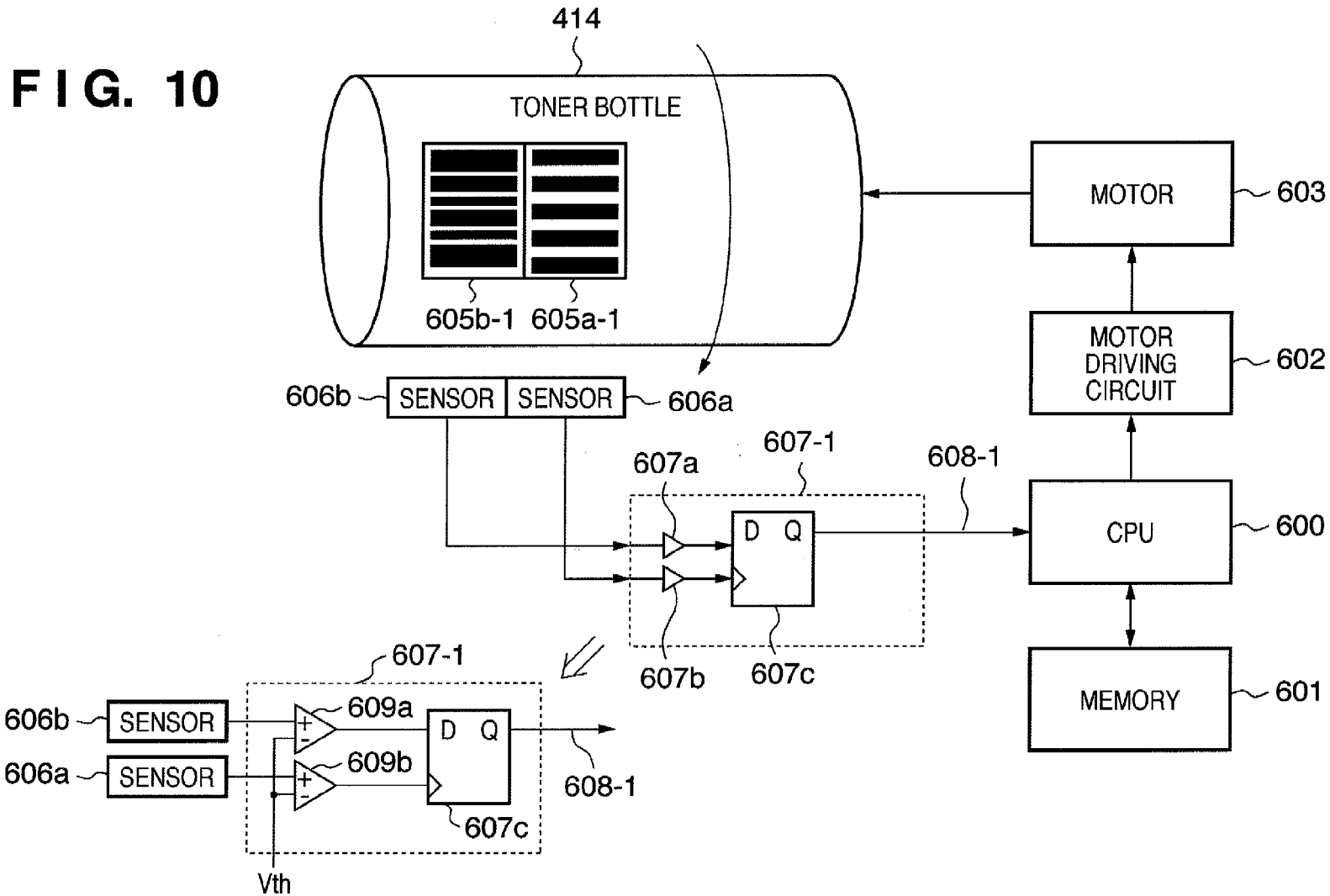
FIG. 10 is a block diagram showing an exemplary detailed configuration of the individual information reading device in Specific Example 1 of Embodiment 1.

Next, a block diagram of Specific Example 1 in which the individual information reading device of Embodiment 1 is reduced to a circuitry level is shown in FIG. 10. In Specific Example 1, a label 605*a*-1 (first label) and a label 605*b*-1 (second label) each composed of a barcode are used. These labels are shown in detail in FIG. 11. Accordingly, the sensors 606*a* and 606*b* are barcode sensors. An exemplary internal circuitry configuration of a data reading circuit 607-1 of the Specific Example 1, which is basically the same as FIG. 6, will now be shown.

Reference numerals 607*a* and 607*b* denote buffers for receiving the output of the sensors 606*a* and 606*b*. Respectively buffered signals are input to a flip-flop (F/F) 607*c*. Here, a signal (reference signal) generated using the equally-spaced barcode 605*a*-1, which is positioned facing and read by the sensor 606*a* (first label reading unit), is input to a clock terminal (clock input terminal) of the F/F 607*c* as a reference clock. A signal generated from the barcode 605*b*-1, which contains individual information of the toner bottle and is positioned facing and read by the sensor 606*b* (second label reading unit), is input to an input terminal (data input terminal) of the F/F 607*c*. Note that the barcodes 605*a*-1 and 605*b*-1 are arranged in the rotation direction of the toner bottle 414 and each bar is arranged with its longitudinal direction at right angle to the rotation direction of the toner bottle 414. The number of bars in the barcode 605*a*-1 corresponds to the data amount of the individual information.

This circuitry configuration enables data to be imported from the label 605*b*-1 at the white/black change points (points where white changes to black in FIG. 11 example) of the label 605*a*-1. In other words, even if variability occurs in the rotation of the toner bottle 414, data can be imported at prescribed intervals on the toner bottle 414, and a stable output 608-1 of the F/F 607*c* is obtained.

Note that the diagram at the bottom of FIG. 10 shows a circuit for switching output between high and low depending on whether the input from the sensors 606*a* and 606*b* is above or below a threshold Vth, in which the buffers 607*a* and 607*b* are replaced by comparators 609*a* and 609*b*. This circuit enables stable reading of labels without being effected by markings on the labels or deterioration of the sensors over time.

Figure 11:
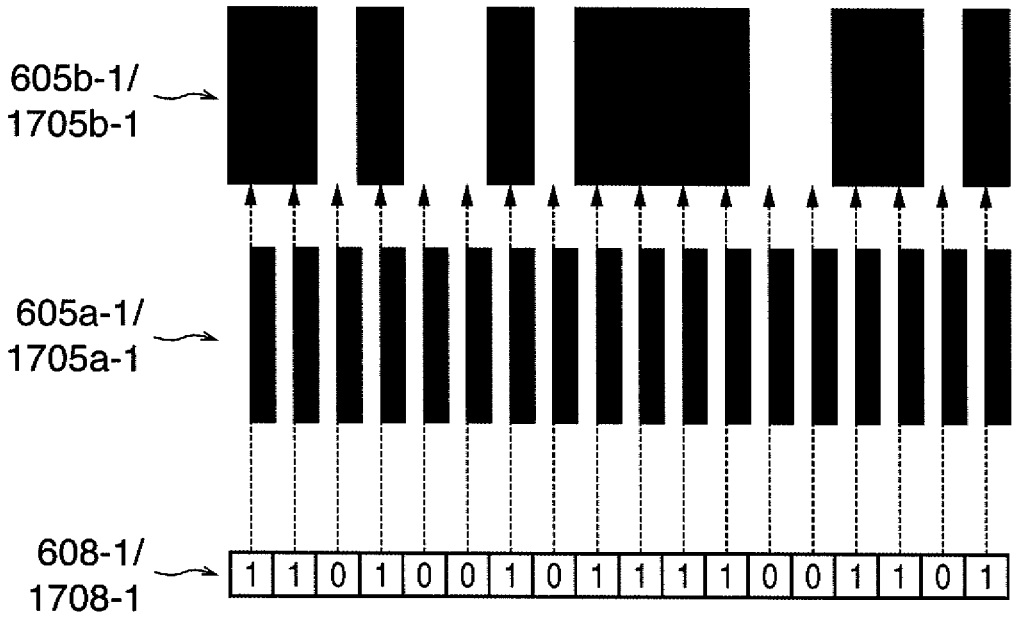
FIG. 11 shows the importation of data in Specific Example 1 of Embodiments 1 and 2.

FIG. 11 illustrates the reading of a label in Specific Example 1. Note that the correspondence with Embodiment 2 shown in FIG. 17 (described below) is shown by the reference numerals.

Reference numeral 605*b*-1 denotes a label showing individual information of a toner bottle, and is a label showing the sampling timing. For example, the circuit in FIG. 10 is configured to read the label 605*a*-1 when the label 605*a*-1 changes from white to black. This enables the problem of label recognition errors in the output 608-1 from the data reading circuit 607-1 to be easily resolved, because the read timing does not deviate even if variability occurs in the rotation of the toner bottle 414.

Note that while the present embodiment has been described in terms of there being two labels, a configuration in which the labels 605*a*-1 and 605*b*-1 are combined into a single label is perfectly acceptable. The single label configuration enables the process of sticking labels to toner bottles to be simplified in comparison to the case where there are two labels.

The present embodiment enables unique data attached to each toner bottle to be read with a simple configuration. The present embodiment also enables the new/used state of toner bottles to be easily recognized.

Note that while the present embodiment has been described in relation to a toner bottle, other detachable units such as a photosensitive drum or a fixing unit can be used in the present invention. A photosensitive drum, for example, deteriorates depending on the number of image forming hours and image formed sheets, so relating the use situation for each unit enables control that depends on the detachable unit, or replaceable unit, such as modifying the image forming conditions (application bias, timing, etc.) or the like. Similarly, since a fixing unit deteriorates according to the number of sheets that pass through the fixing unit, relating the use situation for each unit enables control that depends on the unit.

Specific Example 2 of Individual Information Reading Device of Embodiment 1

Figure 12:
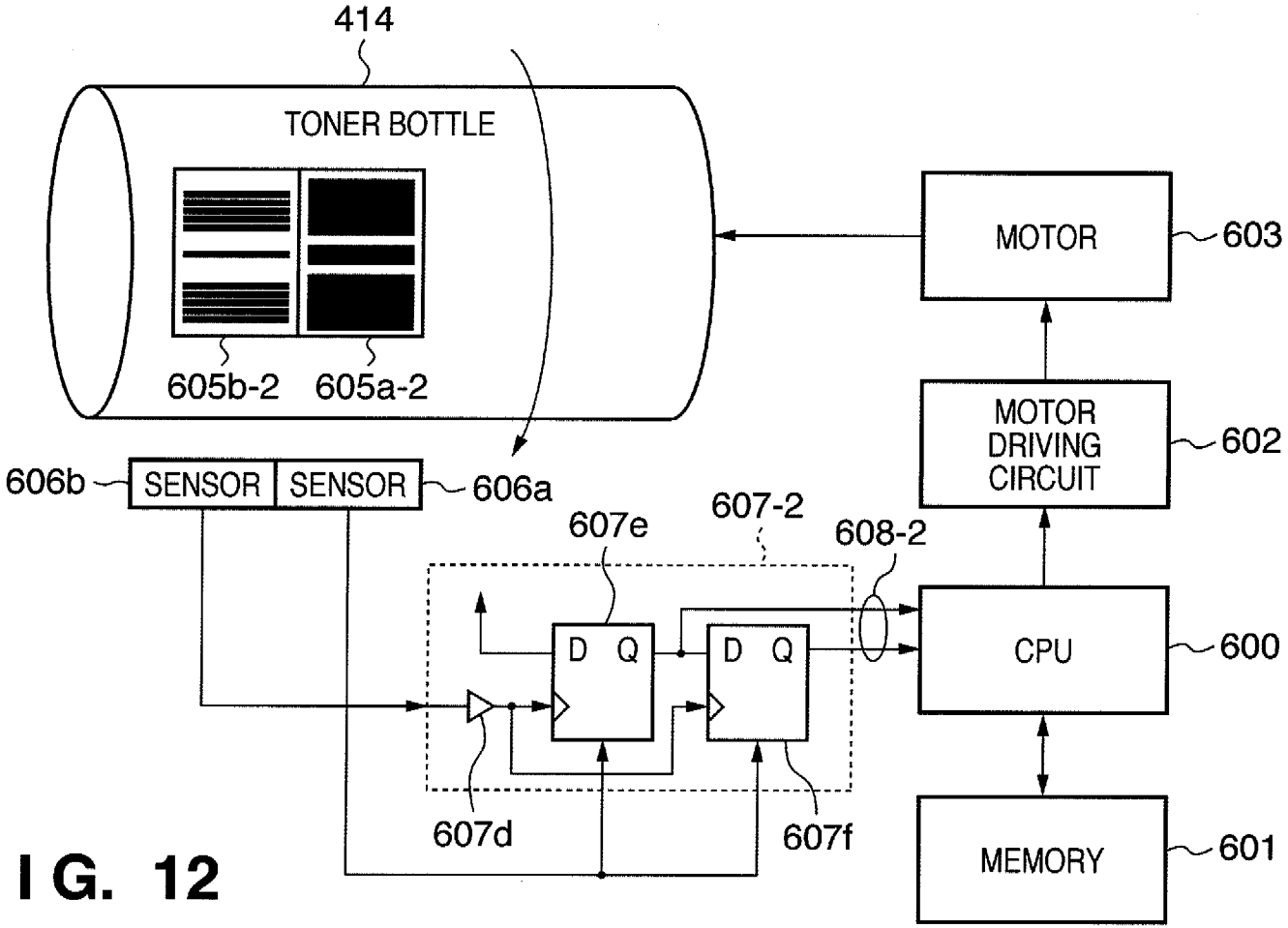
FIG. 12 is a block diagram showing an exemplary detailed configuration of the individual information reading device in Specific Example 2 of Embodiment 1.

Specific Example 2 of Embodiment 1 will now be described. FIG. 12 shows a block diagram of Specific Example 2. Since Specific Example 2 is similar in some respect to Specific Example 1 of Embodiment 1, only the differences with FIG. 10 will be described.

Reference numerals 605*a*-2 and 605*b*-2 denote labels stuck to the toner bottle 414 that contain individual information unique to the toner bottle 414. The labels 605*a*-2 and 605*b*-2 stuck to the toner bottle 414 are read by the sensors 606*a* and 606*b*. Data is read from the sensors 606*a* and 606*b* by a data reading circuit 607-2. An output 608-2 of the data reading circuit 607-2 is input to the CPU 600.

Next, the operations of Specific Example 2 will be described.

Various situations are conceivable in which label reading could be performed, such as when powering on the device or when replacement of the toner bottle is detected, although the present invention is not particularly limited in this respect. To rotate the toner bottle 414, a signal is sent to the motor driving circuit 602, which then rotates the motor 603. The sensors start reading the labels, after a prescribed period has elapsed and a prescribed speed (not a fixed speed) has been reached, and after it has been confirmed that the toner bottle 414 is rotating. Signals obtained from the sensors 606*a* and 606*b* are input to the data reading circuit 607-2. The output 608-2 processed by this circuit is input to the CPU 600. The processed data is also stored in the memory 601 at this time. Also, it is permissible to utilize history data stored in memory, in order to recognize whether the same bottle is still being used.

In Specific Example 2, the labels 605*a*-2 and 605*b*-2, and the internal configuration of the data reading circuit 607-2 differ from Specific Example 1. The output of the sensor 606*a* is connected to the enable terminals of F/Fs 607*e* and 607*f* in the data reading circuit 607-2. The output of the sensor 606*b* is connected to the clock terminals of the F/Fs 607*e* and 607*f* via a buffer 607*d*. The D input terminal of the F/Fs 607*e* is set to "high". The F/Fs 607*e* and 607*f* are connected in series, and the respective outputs thereof are connected to the CPU 600.

Figure 13:
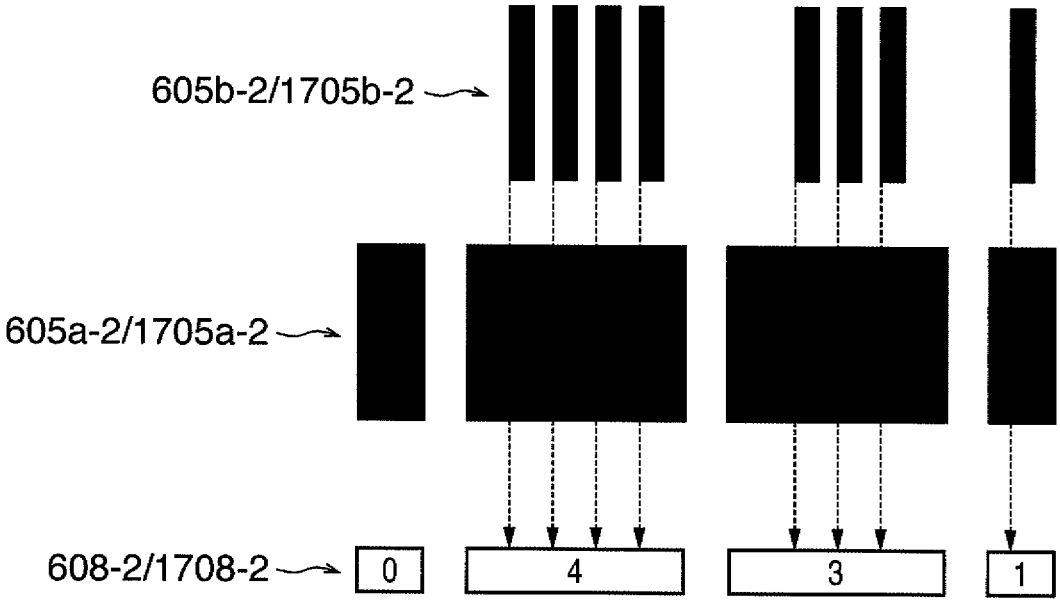
FIG. 13 shows the importation of data in Specific Example 2 of Embodiments 1 and 2.

FIG. 12 shows only two F/Fs connected, although F/Fs equal in number to the bit count of read data are required (16 F/Fs required to handle 16-bit data; at least 4 F/Fs required in FIG. 13 example). Further, it is obvious to a person skilled in the art that configuring a circuit with a plurality of JK flip-flops and reversing the sign whenever the output of the sensor 606*b* is "high" enables read data to be counted in binary. The present invention is not limited to these circuitry configurations of the data reading circuit 607.

In FIG. 13 of Specific Example 2, clocks equal in number to the bars of the label 605*b*-2 will be output with the label 605*a*-2 in a prescribed state (when black in FIG. 13 example). In other words, since the signal input to the CPU 600 will be "high" by counts equal in number to the bars, counting the number of high states of the signal enables the content of read data to be easily recognized.

Also, while not described in detail, it is possible to incorporate specific data into the first and last bits and then recognize the specific data as data delimiters.

Also, storing data in memory and comparing this data with internal data, similarly to Specific Example 1, enables recognition of whether the same toner bottle is still being used.

The labels 605*a*-2 and 605*b*-2 and the output 608-2 in Specific Example 2 will be described in detail with reference to FIG. 13. Note that the correspondence with Embodiment 2 shown in FIG. 17 (described below) is shown by the reference numerals.

Reference numeral 605*b*-2 denotes a label containing data related to individual information of a toner bottle, and 605*a*-2 denotes a label for reading data.

Data can be read accurately by counting the edges of the barcode contained in the label 605*b*-2 with the signals of the label 605*a*-2 as enable signals. For example, the label 605*b*-2 has no bars while the first bar from the left end of the label 605*a*-2 is black. Hence, the data of the output 608-2 will be "0". The second bar from the left end of the label 605*a*-2 corresponds to four bars of the label 605*b*-2, so the data will be "4". Similarly, the subsequent data will be "3" and "1".

Embodiment 2

Hereinafter, Embodiment 2 in which the present invention is applied to an electrophotographic printer constituting an image forming apparatus will be described.

Exemplary Configuration of Image Forming Apparatus

Figure 14:
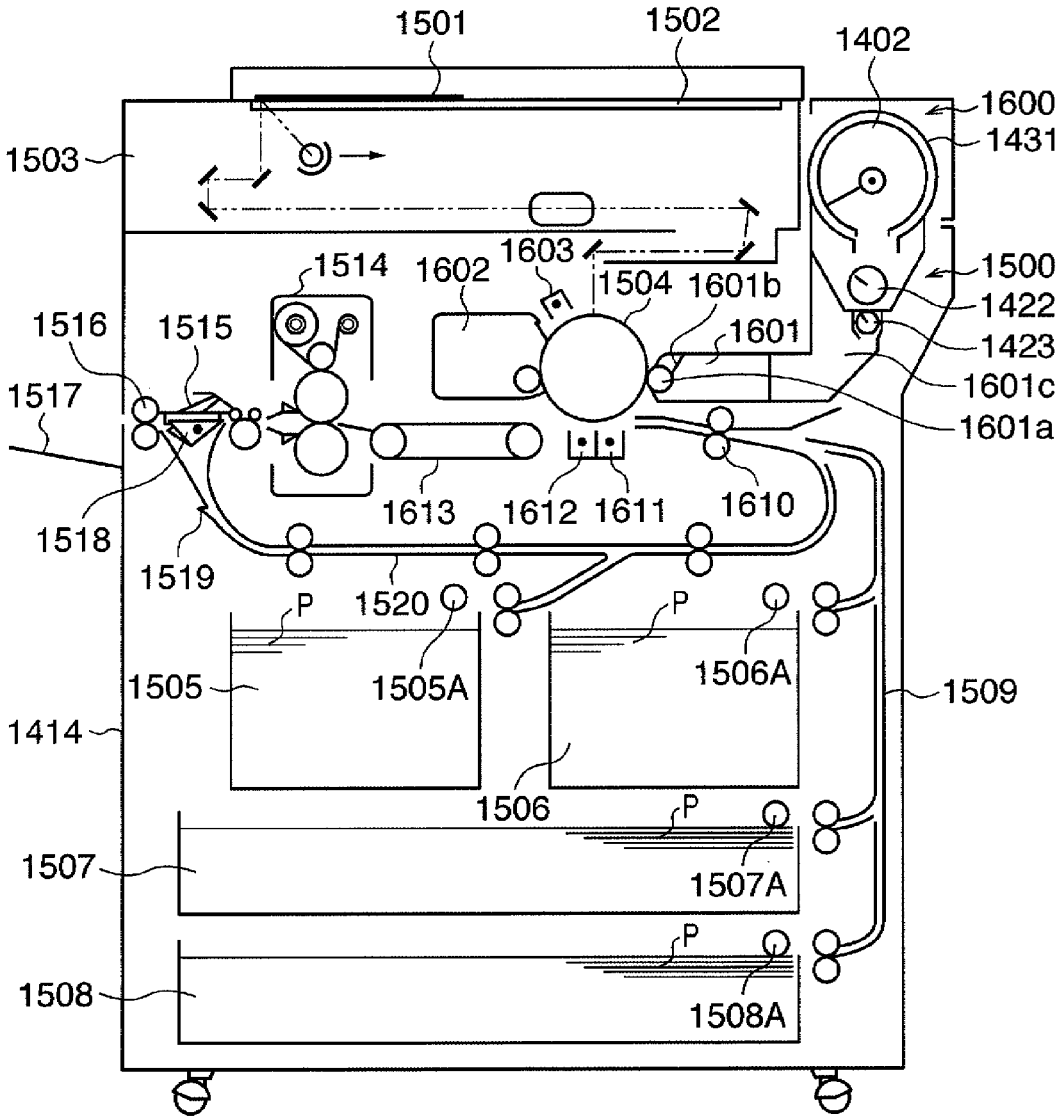
FIG. 14 is a longitudinal sectional view showing an exemplary configuration of an electrophotographic printer according to Embodiment 2.

FIG. 14 shows a longitudinal sectional view of an electrophotographic image forming apparatus having a detachable unit and a typical toner supply device.

An original 1501 is placed on a platen glass 1502, and disposed so that information on the original forms an image on a photosensitive drum 1504 using a plurality of mirrors and a lens of an optical portion 1503. The optimal paper feed cassette is selected using paper size information from paper P loaded in paper feed cassettes 1505 to 1508, based on information input by a user from an operation portion (not shown) or the paper size of the original 1501. A single sheet of the paper P conveyed using one of paper feed or separation rollers 1505A to 1508A is conveyed as far as registration rollers 1510 via a conveying portion 1509. Here, the paper P is conveyed with the scan timing of the optical portion 1503 in synchronous with the rotation of the photosensitive drum 1504. The paper P to which a toner image on the photosensitive drum 1504 has been transferred by transfer/separation chargers 1511 and 1512 is conveyed to a fixing portion 1514 by a conveying portion 1513, and the toner on the paper P is fixed by the fixing portion 1514 using heat and pressure.

Then, (1) in the case of one-sided copying, the paper P passes through a discharging/reversing portion 1515 and is ejected onto a discharge tray 1517 by discharge rollers 1516.

(2) In the case of multiplex copying, the paper P is conveyed along paper refeeding paths 1519 and 1520 by controlling a flapper 1518 of the discharging/reversing portion 1515. The paper P is conveyed as far as the registration rollers 1510, after which it undergoes image forming similarly to the above, passes through the fixing portion, and is this time ejected onto the discharge tray 1517.

(3) In the case of two-sided copying, the paper P passes through the discharging/reversing portion 1515 and is partially ejected to the outside of the apparatus by the discharge rollers 1516. Then, when the trailing edge of the paper P is nipped by the discharge rollers 1516 after passing through the flapper 1518, the paper P is again conveyed into the apparatus by controlling the flapper 1518 and reverse-rotating the discharge rollers 1516. The paper P is conveyed along the paper refeeding paths 1519 and 1520 as far as the registration rollers 1510, undergoes image forming similarly to the above, passes through the fixing portion, and is this time ejected onto the discharge tray 1517.

In an electrophotographic image forming apparatus having the above configuration, units such a developer 1601, a cleaner 1602 and a primary charger 1603 are disposed around the photosensitive drum 1504. The developer 1601 supplies toner for adhering to the photosensitive drum 1504, in order to actualize the information of the original 1501 formed as an electrostatic latent image on the photosensitive drum 1504 by the optical portion 1503. A toner cartridge 1402 for supplying toner to the developer 1601 is thus detachably provided on a holder 1431 of an apparatus body 1414. The toner cartridge 1402 and the holder 1431 constitute a toner supply device 1600 of Embodiment 2.

The developer 1601 has a developing roller 1601*a* with a small gap (approx. 300 μm) provided to the photosensitive drum 1504. In the developing, a thin toner layer is formed on the developing roller 1601*a* in addition to friction charging the toner using a developing blade 1601*b*, and a latent image is developed on the photosensitive drum 1504 by applying a developing bias between the developing roller 1601*a* and the photosensitive drum 1504.

Toner depleted by the developing is supplied from a toner storage 1500 to the developer 1601 via a toner supply area 1601*c*. That is, the toner supply area 1601*c* is filled with toner as a result of toner in the toner storage 1500 being conveyed by first and second toner conveying screws 1422 and 1423 that perform functions equivalent to the toner conveying screw 251 and the toner supply roller 252 in Embodiment 1, and discharged from a discharge outlet 1627.

Exemplary Operations of Toner Supply Device of Embodiment 2

Figure 15:
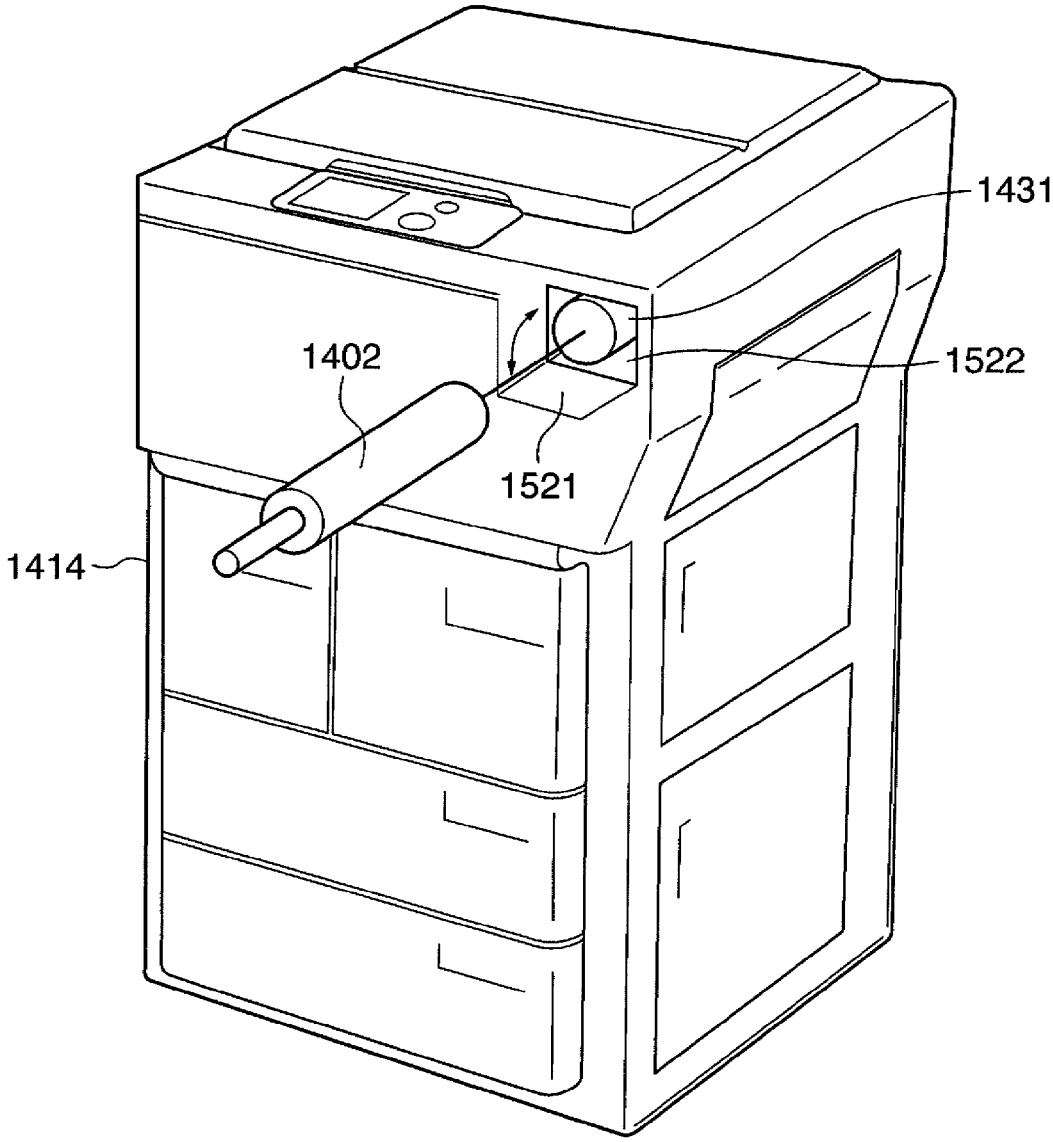
FIG. 15 is a perspective view showing the appearance of the printer in FIG. 14 and the mounting of a toner storage unit.
Figure 16:
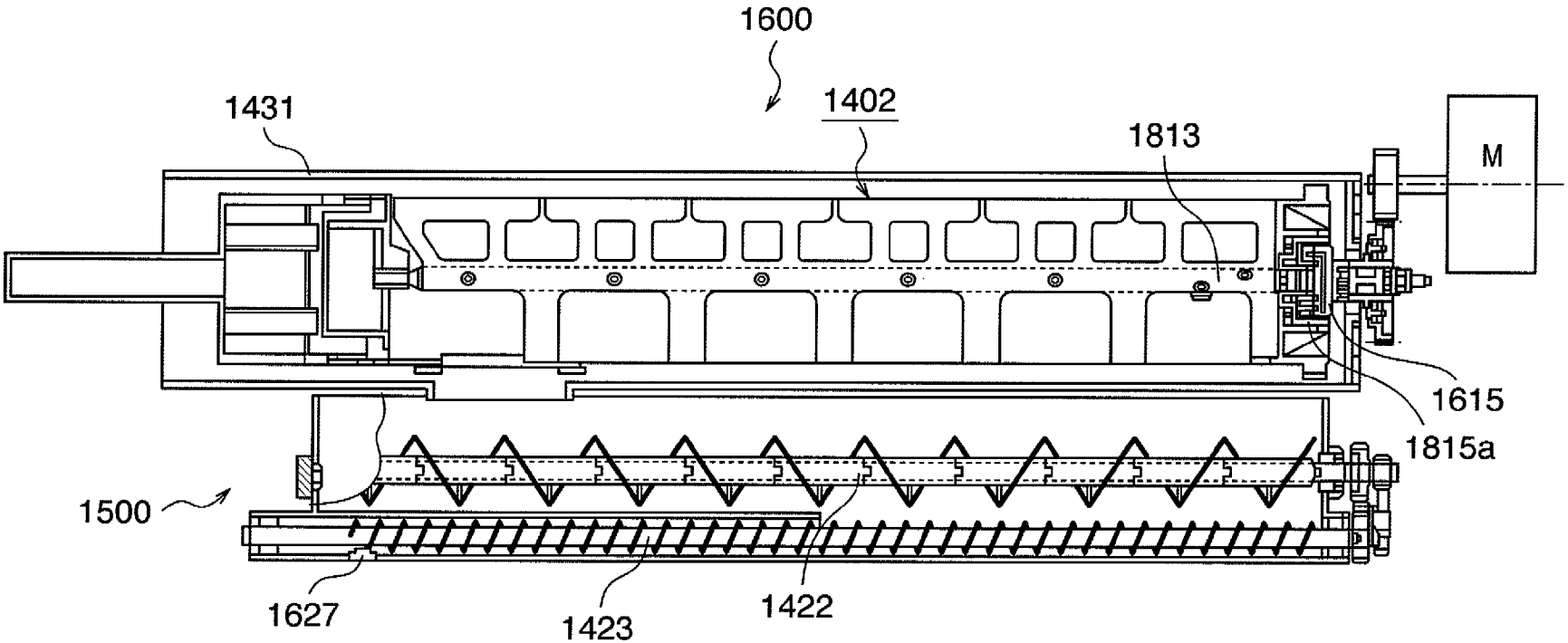
FIG. 16 is a longitudinal sectional view showing a toner supply device of the printer in FIG. 14.

Exemplary operations of the toner supply device 1600 of Embodiment 2 will be described in accordance with FIGS. 15 and 16. The user is notified when a detection portion (not shown) detects that toner in the toner storage 1500 is running out. When the user opens an opening/closing member 1521 mounted on the lower edge of an opening 1522 provided in a upper corner of the front face of the apparatus body 1414, the holder 1431 constituting a mounting portion for removably mounting the toner cartridge 1402 is revealed, as shown in FIG. 15. The cylindrical toner cartridge 1402 is guided by a guide provided in the longitudinal direction of the holder 1431 when inserted into this holder 1431. Then, a passive coupling 1815*a* fixed to a shaft 1813 of the toner cartridge 1402 engages a coupling 1615 provided on the apparatus body 1414, as shown in FIG. 16. When the user closes opening/closing member 1521, power is switched on and the image forming apparatus becomes drivable. Inside the replaced toner cartridge 1402, toner is conveyed to and flows down from the opening as a result of the shaft 1813 being driven by a motor M, and replenishes the toner of the toner storage 1500, thereby enabling toner to be stably supplied to the developer 1601.

Exemplary Configuration of Individual Information Reading Device of Embodiment 2

FIG. 17 is a block diagram showing an exemplary configuration of the individual information reading device in Embodiment 2.

Reference numeral 1700 denotes a CPU that controls the individual information reading device. Reference numeral 1701 denotes a memory that stores data (described below). Reference numeral 1709 denotes a display portion that shows various state of the individual information reading device.

Reference numerals 1705*a* and 1705*b* denote labels stuck to the toner cartridge 1402 constituting a detachable unit, and contain individual information unique to the toner cartridge 1402. The labels 1705*a* and 1705*b* stuck to the toner cartridge 1402 are read by sensors 1706*a* and 1706*b*. Data is read from these sensors 1706*a* and 1706*b* by a data reading circuit 1707. The output 1708 of the data reading circuit 1707 is input to the CPU 1700.

Note that the difference with Embodiment 1 shown in FIG. 6 is a difference in configuration resulting from the difference between the rotating toner bottle 414 and the toner cartridge 1402 inserted in the x direction in FIG. 17. Although the label reading methods are different, the technical ideas are similar.

Next, the operations of individual information reading device in Embodiment 2 will be described.

Various situations are conceivable in which label reading could be performed, such as when the replacement of the toner cartridge 1402 is detected, although the present invention is not particularly limited in this respect. The sensors start reading the labels when the start of an operation to mount or remove the toner cartridge 1402 is detected. Signals obtained from the sensors 1706*a* and 1706*b* are input to the data reading circuit 1707. Data processed by this circuit is input to the CPU 1700. The processed data is also stored in the memory 1701 at this time. Also, it is permissible to utilize history data stored in memory, in order to check the use history of a mountable unit (i.e., whether used or not).

Exemplary Configuration of Control Portion of Embodiment 2

The configuration of the control portion of the individual information reading device in Embodiment 2 is basically similar to the case of Embodiment 1 shown in FIG. 8.

Figure 18:
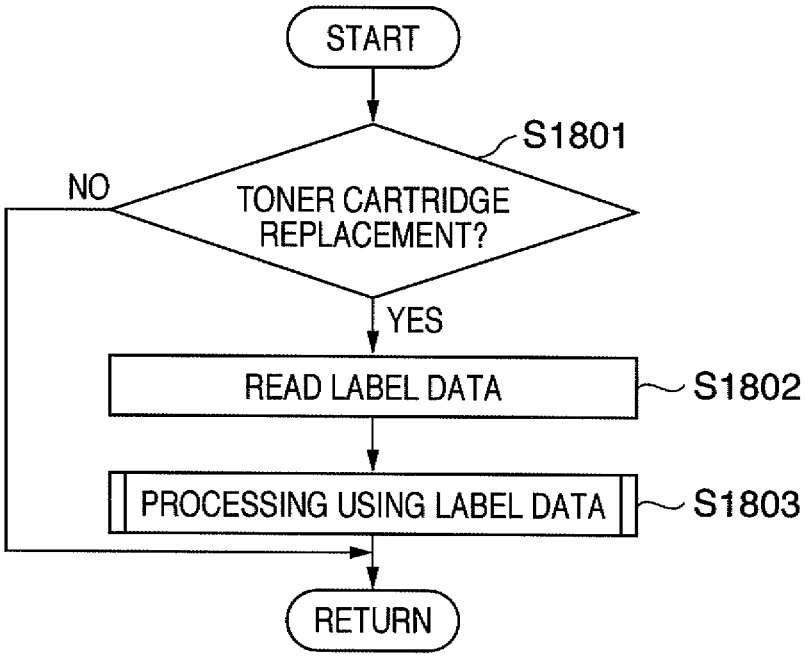
FIG. 18 is a flowchart showing an exemplary operation procedure of the individual information reading device in Embodiment 2.

An exemplary operation procedure included in a toner cartridge recognition program of the present embodiment will now be described in accordance with the flowchart of FIG. 18 showing this exemplary processing procedure.

Firstly, at step S1801, it is determined whether toner cartridge replacement is being performed using an operation to mount or remove the toner cartridge 1402. This determination is realized by a sensor, a switch or the like (not shown). If toner cartridge replacement is not being performed, the processing is ended and returns to the main apparatus control routine. If the toner cartridge replacement is being performed, the processing proceeds to step S1802, where label data reading according to the present embodiment is performed, and the read individual information is stored in a RAM 6012.

At step S1803, processing is performed in accordance with the read label data (individual information). This processing includes, for example, display on the display portion 1709, and also processing to determine the new/used state of a mounted toner cartridge by comparing identification information included in the read individual information with identification information included in the individual information of a read toner cartridge label table 6012*c*. Further, rotation control of the motor M show in FIG. 16 may be performed.

Specific Example 1 of Individual Information Reading Device of Embodiment 2

Figure 19:
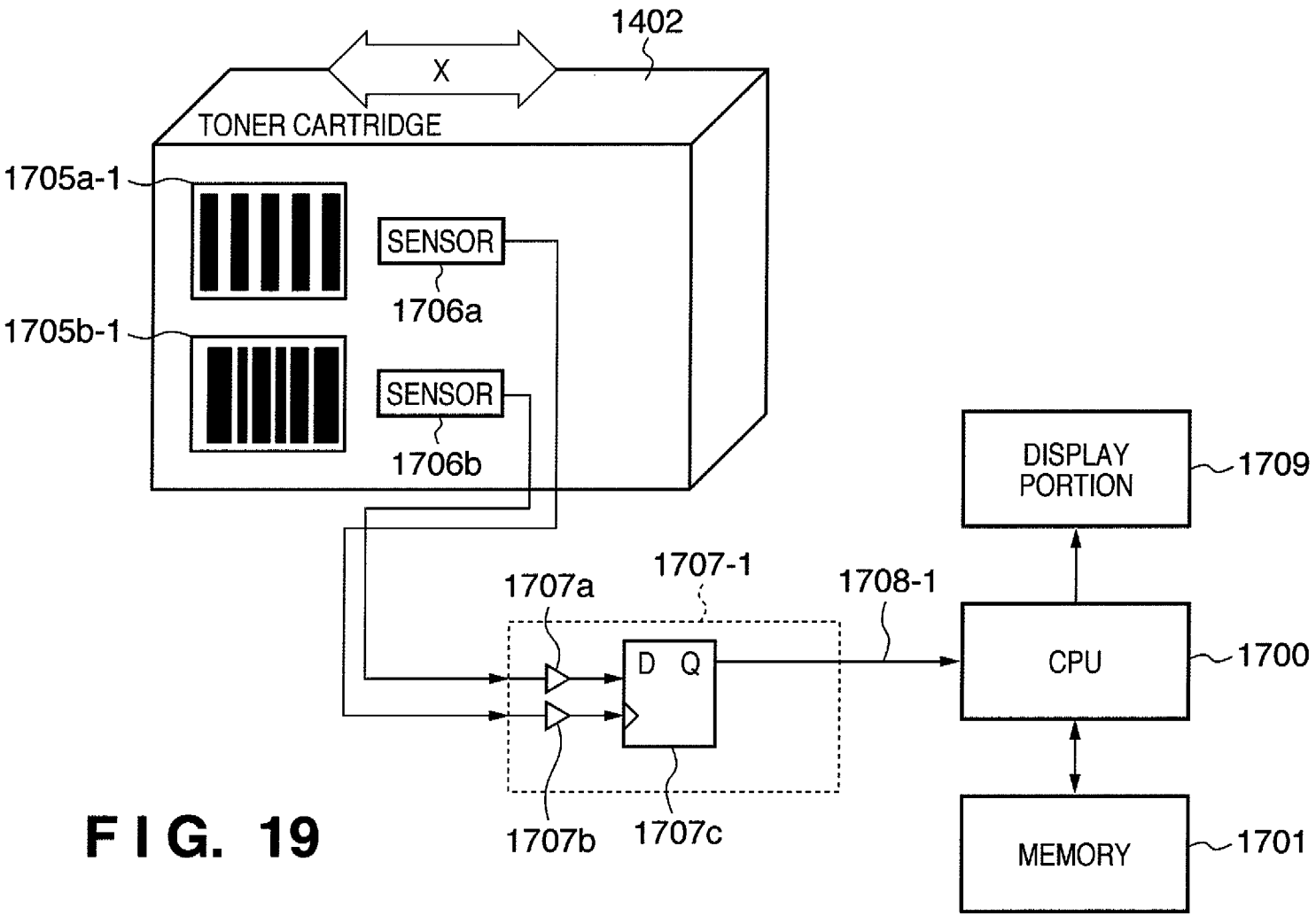
FIG. 19 is a block diagram showing an exemplary detailed configuration of the individual information reading device in Specific Example 1 of Embodiment 2.

Next, a block diagram of Specific Example 1 in which the individual information reading device of Embodiment 2 is reduced to a circuitry level is shown in FIG. 19. In Specific Example 1, a label 1705*a*-1 and a label 1705*b*-1 are used. The details of these labels are similar to FIG. 11 shown earlier.

Reference numerals 1705*a*-1 and 1705*b*-1 denote labels stuck to the toner cartridge 1402, and contain individual information required by the toner cartridge. Labels 1705*a*-1 and 1705*b*-1 stuck to the toner cartridge 1402 are read by sensors 1706*a* and 1706*b*. Data is read from these sensors 1706*a* and 1706*b* by a data reading circuit 1707-1. An output 1708-1 of the data reading circuit 1707-1 is output to the CPU 1700.

The configuration and operations of Specific Example 1 of the individual information reading device in FIG. 19 are similar to the operations in FIG. 17, except for the labels 1705*a*-1 and 1705*b*-1 and the circuitry configuration of the data reading circuit 1707-1. The operations will be described next. An exemplary internal circuitry configuration of the data reading circuit 1707-1 which is characteristic of Specific Example 1 will now be shown.

The outputs of the sensors 1706*a* and 1706*b* are connected to an F/F 1707*c* via buffers 1707*a* and 1707*b* in the data reading circuit 1707-1. Here, the output of the buffer 1707*b* is connected to a D input terminal of the F/F 1707*c*, and the output of the buffer 1707*a* is connected to a clock terminal of the F/F 1707*c* as a reference clock. The output 1708-1 of the F/F 1707*c* is output to the CPU 1700. Note that the labels 1705*a*-1 and 1705*b*-1 are arranged in the direction X in which the toner cartridge 1402 is inserted and each bar is arranged with its longitudinal direction at right angle to the insertion direction X of the toner cartridge 1402. The number of bars of the label 1705*a*-1 corresponds to the data amount of the individual information.

As previously described in Specific Example 1 of Embodiment 1 with reference to FIG. 11, the labels 1705*a*-1 and 1705*b*-1 respectively show the sampling timing and individual information of the toner cartridge. Reading the label 1705*b*-1 at the timing of the label 1705*a*-1 enables correct data to be read, without being affected by the various operating speeds of users. For example, the circuit is configured to read the label 1705*b*-1 when the label 1705*a*-1 changes from white to black. This read timing enables data to be read at a desired place, even if the insertion speed of the detachable unit varies.

While not discussed detail, data could conceivably be inverted when the detachable unit is attached or detached. However, incorporating a prescribed pattern in the first bit/last bit and processing data based on this prescribed pattern enables data to be correctly read when the detachable unit is both attached and detached.

Specific Example 2 of Individual Information Reading Device of Embodiment 2

Figure 20:
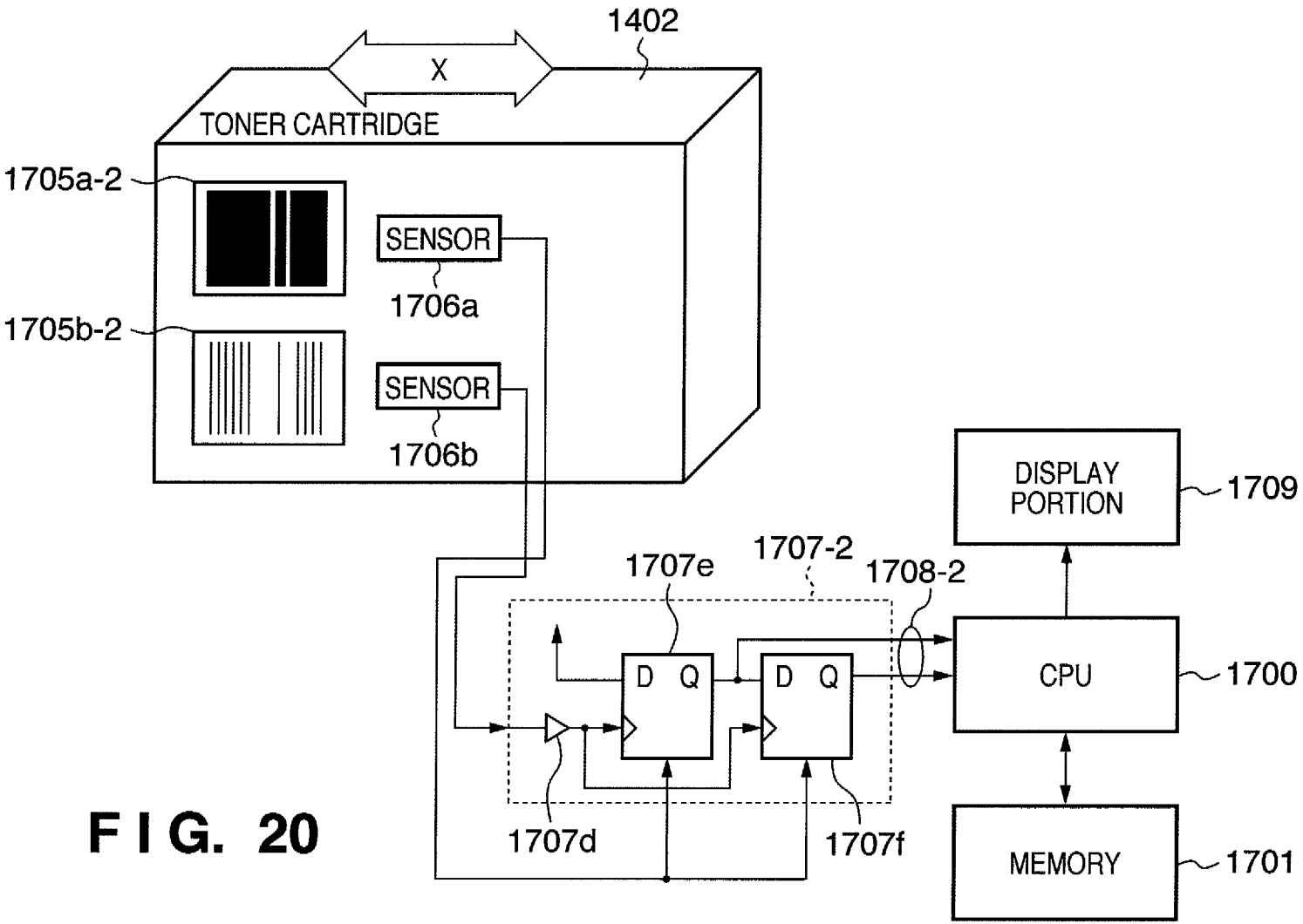
FIG. 20 is a block diagram showing an exemplary detailed configuration of the individual information reading device in Specific Example 2 of Embodiment 2.
Figure 21:
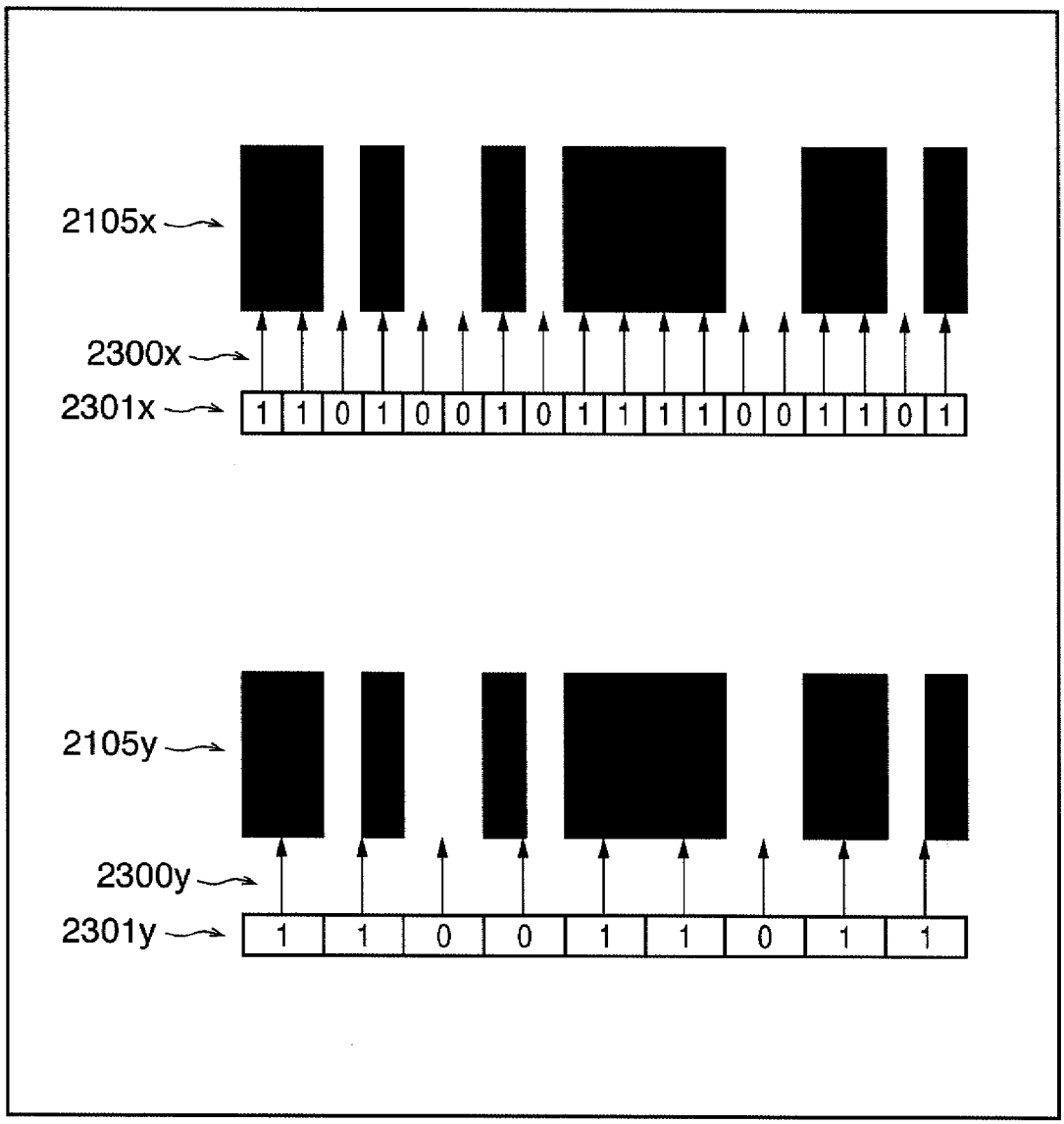
FIG. 21 shows a conventional defect with a single label.

FIG. 20 shows a block diagram of Specific Example 2 of Embodiment 2. Since Specific Example 2 is similar in some respect to Specific Example 1, only the differences with FIG. 19 will be described.

The output of the sensor 1706*a* is connected to the enable terminals of F/Fs 1707*e* and 1707*f* in the data reading circuit 1707-2, and the output of the sensor 1706*b* is connected to the clock terminals of the F/Fs 1707*e* and 1707*f* via a buffer 1707*d*. The D input terminal of the F/F 1707*e* is set to "high". The F/Fs 1707*e* and 1707*f* are connected in series, and their respective outputs 1708-2 are connected to the CPU 1700. FIG. 20 shows only two F/Fs connected, although F/Fs equal in number to the bit count of read data are required (16 F/Fs are required to handle 16-bit data). Further, it is obvious to a person skilled in the art that configuring a circuit with a plurality of JK flip-flops and reversing the sign whenever the output of the sensor 1706*b* is "high" enables read data to be counted in binary. The present invention is not limited to these circuitry configurations of the data reading circuit 1707.

In FIG. 20 of Specific Example 2, clocks equal in number to the bars of the label 1705*b*-2 will be output with the label 1705*a*-2 in a prescribed state (when black in the given example), similarly to FIG. 13 of Specific Example 2 in Embodiment 1. In other words, since the signals, equal in number to the bars, input to the CPU 1700 will be "high", counting the number of signals enables the content of read data to be easily recognized.

Also, while not described in detail, it is possible to incorporate specific data into the first bit/last bit, and recognize this data as data delimiters.

Also, storing data in memory and comparing this data with internal data enables recognition of whether the same detachable unit is still being used.

Note that even in Embodiment 2, a buffer can be realized with a reference voltage and a comparator, as shown in the diagram at the bottom of FIG. 10.

Note that while the present embodiment has been described in terms of there being two labels, a configuration in which the labels 1705*a*-1 and 1705*b*-1 are combined into a single label is perfectly acceptable.

Note that the present invention may be applied to a system constituted by a plurality of devices (e.g., computer, interface device, reader, printer, etc.) or a layout apparatus composed of a single device.

The object of the present invention may also be attained by inserting a storage medium storing program code for realizing the procedures of the flowcharts shown in the foregoing embodiments in a system or an apparatus, and reading and executing the program code stored in the storage medium with a computer (or CPU, MPU) in the system or apparatus.

In this case, the actual program code read from the storage medium realizes the functions of the forgoing embodiments, and the storage medium storing the program code constitutes the present invention.

Examples of storage media that can be used for supplying the program include floppy disk, hard disk, optical disk, magneto-optical disk, CD-ROM, CD-R, magnetic tape, nonvolatile memory card, and ROM.

The present invention also covers the case where an operating system or the like running on the computer performs part or all of the actual processing based on instructions in the program code read by the computer, with the functions of the foregoing embodiments being realized by this processing.

Further, the present invention also covers the case where the program code read from the storage medium is written to a memory provided in a function expansion board inserted in the computer or a function expansion unit connected to the computer, and a CPU or the like provided in the function expansion board or the function expansion unit then performs part or all of the actual processing based on instructions in the program code, with the functions of the foregoing embodiments being realized by this processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-135950, filed May 22, 2007, which is hereby incorporated by reference herein in its entirety.

What is claimed is:

1. A method of reading individual information of a detachable unit that is adapted to be mounted in an apparatus and that has, on a surface thereof, a first label for generating a reference signal for reading individual information, and a second label representing the individual information, the method comprising:

reading, with a first label reading unit, the first label in a predetermined direction while generating the reference signal; and reading, with a second label reading unit, the individual information of the detachable unit contained in the second label, in synchronism with the generated reference signal;

wherein the second label is a barcode having bars corresponding in number to data of the individual information, and the first label is a barcode for generating an enable signal for counting the bars in the second label.

2. The method according to claim 1, wherein the reading of the individual information is performed when powering on the apparatus or when mounting the detachable unit to the apparatus.

3. The method according to claim 1, wherein the apparatus is an image forming apparatus, and the detachable unit is a toner bottle for supplementing toner.

4. The method according to claim 1, wherein the apparatus is an image forming apparatus, and the detachable unit is a toner cartridge for supplementing toner.

5. An individual information reading device for reading individual information of a detachable unit that is mountable in or on an apparatus and that has on a surface thereof a first label for generating a reference signal for reading individual information and a second label representing the individual information, the individual information reading device comprising:

a first label reading unit operable to read, the first label in a predetermined direction while generating the reference signal; and a second label reading unit operable to read the individual information of the detachable unit contained in the second label in synchronism with the generated reference signal;

wherein the second label is a barcode having bars corresponding in number to data of the individual information, and the first label is a barcode for generating an enable signal for counting the bars in the second label.

6. The individual information device according to claim 5, further comprising a control unit for bringing about the reading of the individual information by the first and second label reading units when powering on the apparatus or when mounting the detachable unit to the apparatus.

7. The individual information device according to claim 5, wherein the apparatus is an image forming apparatus, and the detachable unit is a toner bottle for supplementing toner.

8. An apparatus adapted to have a detachable unit mounted in or on it and comprising an individual information reading device according to claim 5.

9. The apparatus according to claim 8, further comprising:

a storage unit for storing read individual information; and a recognition unit operable to compare the read individual information with individual information already stored in the storage unit, and to recognize that the detachable unit is a reused detachable unit if identification information included in the read individual information matches identification information included in the stored individual information.

10. The apparatus according to claim 8, wherein the apparatus is an image forming apparatus.

11. A detachable unit adapted to be mounted in or on an apparatus that reads individual information of the detachable unit when the detachable unit is mounted in or on the apparatus, the detachable unit having, on a surface thereof, a first label, readable by the apparatus to generate a reference signal, and a second label, representing said individual information of the detachable unit and readable by the apparatus using the reference signal;

wherein the second label is a barcode having bars corresponding in number to data of the individual information, and the first label is a barcode for generating an enable signal for counting the bars in the second label.

* * * * *